US011653691B2

(12) United States Patent
Karles et al.

(10) Patent No.: US 11,653,691 B2
(45) **Date of Patent: *May 23, 2023**

(54) SENSOR APPARATUSES AND SYSTEMS

(71) Applicant: Altria Client Services LLC, Richmond, VA (US)

(72) Inventors: Georgios Karles, Richmond, VA (US); Jeffery S. Edmiston, Mechanicsville, VA (US); William A. Rees, Richmond, VA (US); David B. Kane, Richmond, VA (US)

(73) Assignee: Altria Client Services LLC, Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/361,440

(22) Filed: Jun. 29, 2021

(65) Prior Publication Data

US 2021/0321660 A1 Oct. 21, 2021

Related U.S. Application Data

(63) Continuation of application No. 16/268,837, filed on Feb. 6, 2019, now Pat. No. 11,064,727.

(51) Int. Cl.
*A24C 5/34* (2006.01)
*A24F 40/80* (2020.01)

(52) U.S. Cl.
CPC ..... *A24C 5/34* (2013.01); *A24C 5/3406* (2013.01); *A24F 40/80* (2020.01)

(58) Field of Classification Search
CPC ..... A24C 5/3406
See application file for complete search history.

(56) References Cited

U.S. PATENT DOCUMENTS 5,363,842 A 11/1994 Mishelevich et al.
6,799,576 B2 10/2004 Farr
(Continued)

FOREIGN PATENT DOCUMENTS

EP 0824927 A2 2/1998
WO WO-2004047570 A2 * 6/2004 ..... A24C 5/34
(Continued)

OTHER PUBLICATIONS

Spindle et.al. 'Prelimenary Resuts of an Examination of Electronic Cigarette User Puff Topography: The Effect of a Mouthpiece-Based Topography Measurement Device on Plasma Nicotine and Subjective Effects' Nictone &Tobacco Research 2015, vol. 17, No. 2 pp. 142-149.
(Continued)

*Primary Examiner* — Santosh R Poudel
(74) *Attorney, Agent, or Firm* — Harness, Dickey & Pierce, P.L.C.

(57) ABSTRACT

A sensor apparatus may include a conduit structure including an inner surface defining a conduit extending through an interior of the conduit structure, an inlet structure coupled to an end of the conduit structure, and a plurality of sensor devices in hydrodynamic contact with the conduit. The inlet structure may couple with an outlet end of an external tobacco element to hold the outlet end of the external tobacco element in fluid communication with an inlet opening of the conduit structure, such that the conduit structure may receive a generated aerosol from the external tobacco element at the inlet opening, and draw an instance of aerosol through the conduit towards an outlet opening. The instance of aerosol may include at least a portion of the generated aerosol. Each sensor device may generate sensor data indicating a pressure of the instance of aerosol through a separate portion of the conduit.

10 Claims, 8 Drawing Sheets

(56) References Cited

U.S. PATENT DOCUMENTS

| | | | | |
|---|---|---|---|---|
| 6,814,083 | B2 | 11/2004 | Likness et al. | |
| 7,164,993 | B2 | 1/2007 | Likness et al. | |
| 7,610,919 | B2 | 11/2009 | Utley et al. | |
| 7,779,841 | B2 | 8/2010 | Dunsmore et al. | |
| 8,205,054 | B2 | 6/2012 | Usami | |
| 8,534,284 | B2 | 9/2013 | Dunsmore et al. | |
| 2006/0099554 | A1* | 5/2006 | Frost | A24C 5/3406 434/236 |
| 2008/0241255 | A1 | 10/2008 | Rose et al. | |
| 2012/0255567 | A1 | 10/2012 | Rose et al. | |
| 2014/0278250 | A1* | 9/2014 | Smith | A24F 40/90 702/187 |
| 2015/0181945 | A1 | 7/2015 | Tremblay | |
| 2015/0272220 | A1 | 10/2015 | Spinka et al. | |
| 2015/0272222 | A1 | 10/2015 | Spinka et al. | |
| 2016/0007648 | A1 | 1/2016 | Sutton et al. | |
| 2016/0029693 | A1 | 2/2016 | Klein et al. | |
| 2016/0171164 | A1 | 6/2016 | Kinzer | |
| 2016/0219933 | A1 | 8/2016 | Henry, Jr. et al. | |
| 2016/0250201 | A1 | 9/2016 | Rose et al. | |
| 2016/0278435 | A1 | 9/2016 | Choukroun et al. | |
| 2016/0363572 | A1 | 12/2016 | Blackley | |
| 2017/0100550 | A1 | 4/2017 | Van De Laar et al. | |
| 2017/0135401 | A1 | 5/2017 | Dickens | |
| 2018/0263283 | A1 | 9/2018 | Popplewell et al. | |
| 2019/0142067 | A1 | 5/2019 | Martzel | |
| 2019/0320718 | A1 | 10/2019 | Yilmaz et al. | |
| 2020/0154773 | A1 | 5/2020 | Lim et al. | |

FOREIGN PATENT DOCUMENTS

| | | | |
|---|---|---|---|
| WO | WO-2016/079533 | A1 | 5/2016 |
| WO | WO-2017071879 | A1 | 5/2017 |
| WO | WO-2017071964 | A1 | 5/2017 |

OTHER PUBLICATIONS

Gee et.al. 'Assesment of tobacco heating product THP1.0 Part 8: Study to determine puffing topography, mouth level exposure and consumption among Japanese users' Regulatory Toxicology and Pharmacology93 (2018 pp. 84-91.

Spindle et.al. 'The Influence of a Mouthpiece-Based Topography Measurement Device on Electronic Cigarette User's Plasma Nicotine Concentration. Heart Rate, and Subjective Effects Under Directed and AD Libitium Use Conditions' Nicotine & Tobacco Research, vol. 19, No. 4, Apr. 1, 2017 pp. 469-476.

Beginner's Guide: Different Types of Vapes Explained, uthlessvpaor.com/blogs/ruthless-e-liquid/different-types-of-vapes, Mar. 21, 2018 (Year: 2018).

* cited by examiner

SENSOR APPARATUSES AND SYSTEMS

CROSS-REFERENCE TO RELATED APPLICATIONS

This application is a continuation of U.S. application Ser. No. 16/268,837, filed on Feb. 6, 2019 the entire contents of which are incorporated herein by reference.

BACKGROUND

Field

The present disclosure relates generally to sensor apparatuses and more particularly to sensor apparatuses configured to couple with external tobacco elements, where aerosol drawn through the sensor apparatuses may include aerosol generated by the external tobacco elements.

Description of Related Art

Some sensor apparatuses may be used to monitor flows (e.g., mass flow rate, volumetric flow rate, or the like).

SUMMARY

According to some example embodiments, a sensor apparatus may include a conduit structure, an inlet structure, and a plurality of sensor devices. The conduit structure may include an inlet opening, an outlet opening, and an inner surface defining a conduit extending between the inlet opening and the outlet opening through an interior of the conduit structure. The inlet structure may be coupled to an inlet opening-proximate end of the conduit structure. The inlet structure may be further configured to couple with an outlet end of an external tobacco element to hold the outlet end of the external tobacco element in fluid communication with the inlet opening of the conduit structure. The conduit structure may be configured to receive a generated aerosol from the external tobacco element at the inlet opening and draw an instance of aerosol through the conduit towards the outlet opening. The instance of aerosol may include at least a portion of the generated aerosol. The plurality of sensor devices may be hydrodynamic contact with the conduit. Each sensor device may be configured to generate sensor data indicating a pressure of the instance of aerosol drawn through a separate portion of the conduit.

The sensor apparatus may further include a communication interface configured to establish a communication link with an external computing device, the communication interface further configured to communicate a sensor data stream, between the sensor apparatus and the external computing device via the communication link. The sensor data stream may provide a real-time indication of a flow rate of the instance of aerosol through the conduit.

The communication interface is a wireless communication interface and the communication link may be a wireless network communication link.

The sensor apparatus may further include a flow control device that is configured to control a flow rate of the instance of aerosol through the conduit. The sensor apparatus may be configured to control the flow control device.

The sensor apparatus may further include a communication interface configured to establish a communication link with an external computing device. The communication interface may be configured to communicate a sensor data stream, between the sensor apparatus and the external computing device via the communication link. The sensor data stream may provide a real-time indication of the flow rate of the instance of aerosol through the conduit. The sensor apparatus may be configured to control the flow control device based on a feedback control signal received from the external computing device at the communication interface.

The communication interface may be a wireless communication interface and the communication link may be a wireless network communication link.

The sensor apparatus may be configured to control the flow control device to cause an aerosol draw pattern of the instance of aerosol drawn through the conduit of the sensor apparatus over a period of time to conform to a threshold aerosol draw pattern. The aerosol draw pattern may be associated with the sensor data.

The flow control device may include an adjustable valve device configured to adjustably control a cross-sectional flow area of a portion of the conduit.

The flow control device may include an adjustable vent device configured to adjustably direct a separate portion of the generated aerosol to flow to an ambient environment as a bypass aerosol.

The flow control device may include an adjustable intake device configured to adjustably draw bypass air from an ambient environment into the conduit and to the outlet opening.

The sensor apparatus may further include a flow control device that is configured to control a flow rate of the portion of the generated aerosol through the conduit. The sensor apparatus may be configured to control the flow control device.

The sensor apparatus may further include a feedback device configured to generate an externally observable feedback signal based on a determination that an aerosol draw pattern of the instance of aerosol drawn through the conduit of the sensor apparatus over a period of time exceeds a threshold aerosol draw pattern. The aerosol draw pattern may be associated with the sensor data.

According to some example embodiments, a system may include the sensor apparatus, and a computing device communicatively linked to a communication interface of the sensor apparatus via a communication link. The sensor apparatus may be configured to communicate, between the sensor apparatus and the computing device via the communication link, a data stream providing a real-time indication of a flow rate of the instance of aerosol drawn through the conduit. The data stream may include information associated with the sensor data. At least one device of the sensor apparatus or the computing device may be configured to process the information associated with the sensor data to generate topography information associated with at least one of the sensor apparatus and the external tobacco element.

The communication interface may be a wireless communication interface and the communication link may be a wireless network communication link.

The topography information may include an aerosol draw pattern of the instance of aerosol drawn through the conduit of the sensor apparatus over a period of time, the aerosol draw pattern associated with the sensor data. The at least one device may be configured to determine whether the aerosol draw pattern conforms to a threshold aerosol draw pattern, based on processing the topography information.

The at least one device may be the computing device. The computing device may be further configured to communicate a feedback control signal to the sensor apparatus according to the determination of whether the aerosol draw pattern conforms to the threshold aerosol draw pattern. The sensor apparatus may be configured to control a flow rate of the portion of the generated aerosol through the conduit based on the feedback control signal.

The at least one device may be configured to determine that the instance of aerosol is being drawn through the conduit to the outlet opening, based on monitoring a variation in pressure in a portion of the conduit over a period of time.

According to some example embodiments, a method may include generating, at a sensor apparatus, sensor data indicating a flow rate of an instance of aerosol that is drawn through a conduit of the sensor apparatus from an external tobacco element coupled to the sensor apparatus. The method may include communicating a data stream between the sensor apparatus and an external computing device via a communication link, the data stream providing a real-time indication or near real-time indication of the flow rate of the instance of aerosol through the conduit. The data stream may include information associated with the sensor data. The method may include processing the information associated with the sensor data, at at least one device of the sensor apparatus and the external computing device, to generate topography information associated with the sensor apparatus.

The communication link may be a wireless network communication link.

The topography information may include an aerosol draw pattern of the instance of aerosol drawn through the conduit of the sensor apparatus over a period of time, the aerosol draw pattern associated with the sensor data. The method may further include determining whether the aerosol draw pattern conforms to a threshold aerosol draw pattern, based on processing the topography information.

The method may further include generating a feedback control signal that, when processed by the sensor apparatus, causes the sensor apparatus to control a feedback device of the sensor apparatus to generate an externally observable feedback signal based on the determination of whether the aerosol draw pattern conforms to the threshold aerosol draw pattern.

The at least one device may be the external computing device. The method may further include generating a feedback control signal that, when processed by the sensor apparatus, causes the sensor apparatus to control a flow control device at the sensor apparatus to control the flow rate of the instance of aerosol drawn through the conduit based on the determination of whether the aerosol draw pattern conforms to the threshold aerosol draw pattern.

The at least one device may be the external computing device. The instance of aerosol may include at least a portion of a generated aerosol that is generated at the external tobacco element and is drawn from the external tobacco element through a portion of the conduit of the sensor apparatus. The method may further include generating a feedback control signal that, when processed by the sensor apparatus, causes the sensor apparatus to control a flow control device at the sensor apparatus to control a flow rate of the portion of the generated aerosol drawn through the conduit based on the determination of whether the aerosol draw pattern conforms to the threshold aerosol draw pattern.

The controlling the flow control device may cause a cumulative amount of the portion of the generated aerosol drawn through the conduit over a period of time to conform to a threshold cumulative amount.

BRIEF DESCRIPTION OF THE DRAWINGS

The various features and advantages of the non-limiting example embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

DETAILED DESCRIPTION OF EXAMPLE EMBODIMENTS

Figure 1A:
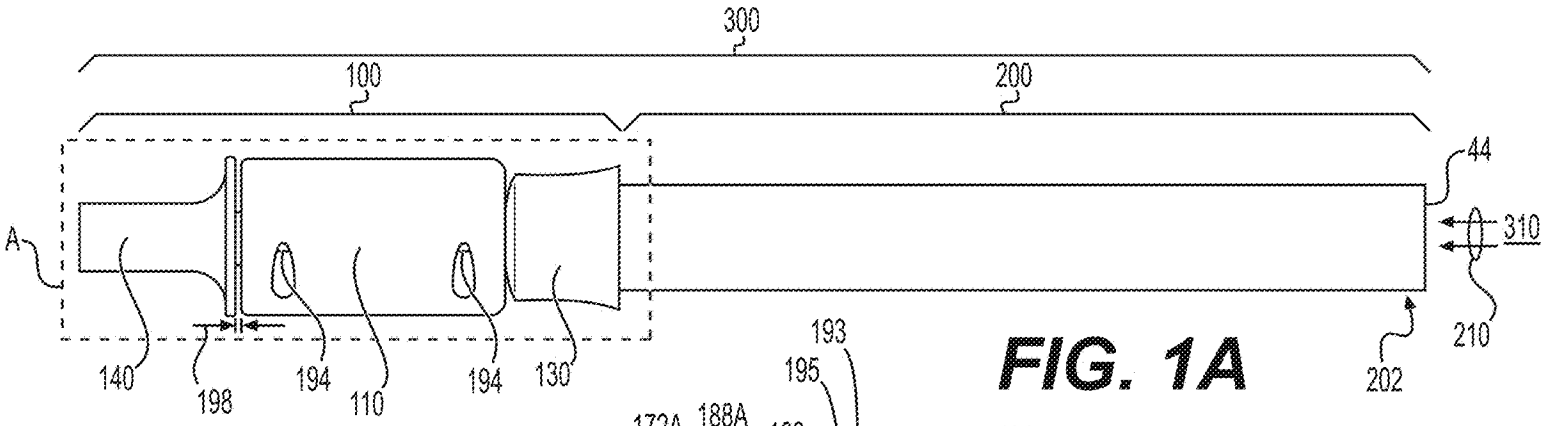
FIG. 1A is a side view of an assembly that includes a sensor apparatus and external tobacco element according to some example embodiments.

Some detailed example embodiments are disclosed herein. However, specific structural and functional details disclosed herein are merely provided for purposes of describing example embodiments. Example embodiments may, however, be embodied in many alternate forms and should not be construed as limited to only some example embodiments set forth herein.

Accordingly, while example embodiments are capable of various modifications and alternative forms, example embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives falling within the scope of example embodiments. Like numbers refer to like elements throughout the description of the figures.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations of one or more of the associated listed items.

It should be understood that, although the terms first, second, third, etc. may be used herein to describe various elements, components, regions, layers and/or sections, these elements, components, regions, layers, and/or sections should not be limited by these terms. These terms are only used to distinguish one element, component, region, layer, or section from another region, layer, or section. Thus, a first element, component, region, layer, or section discussed below could be termed a second element, component, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

When the terms "about" or "substantially" are used in this specification in connection with a numerical value, it is intended that the associated numerical value include a tolerance of ±10% around the stated numerical value. The expression "up to" includes amounts of zero to the expressed upper limit and all values therebetween. When ranges are specified, the range includes all values therebetween such as increments of 0.1%. Moreover, when the words "generally" and "substantially" are used in connection with geometric shapes or other descriptions, it is intended that precision of the geometric shape or description is not required but that latitude for the shape or description is within the scope of the disclosure. Although the tubular elements of the embodiments may be cylindrical, other tubular cross-sectional forms are contemplated, such as square, rectangular, oval, triangular and others.

The terminology used herein is for the purpose of describing various example embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, elements, and/or components, etc., but do not preclude the presence or addition of one or more other features, integers, steps, operations, elements, components, etc., and/or groups thereof.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

Figure 1B:
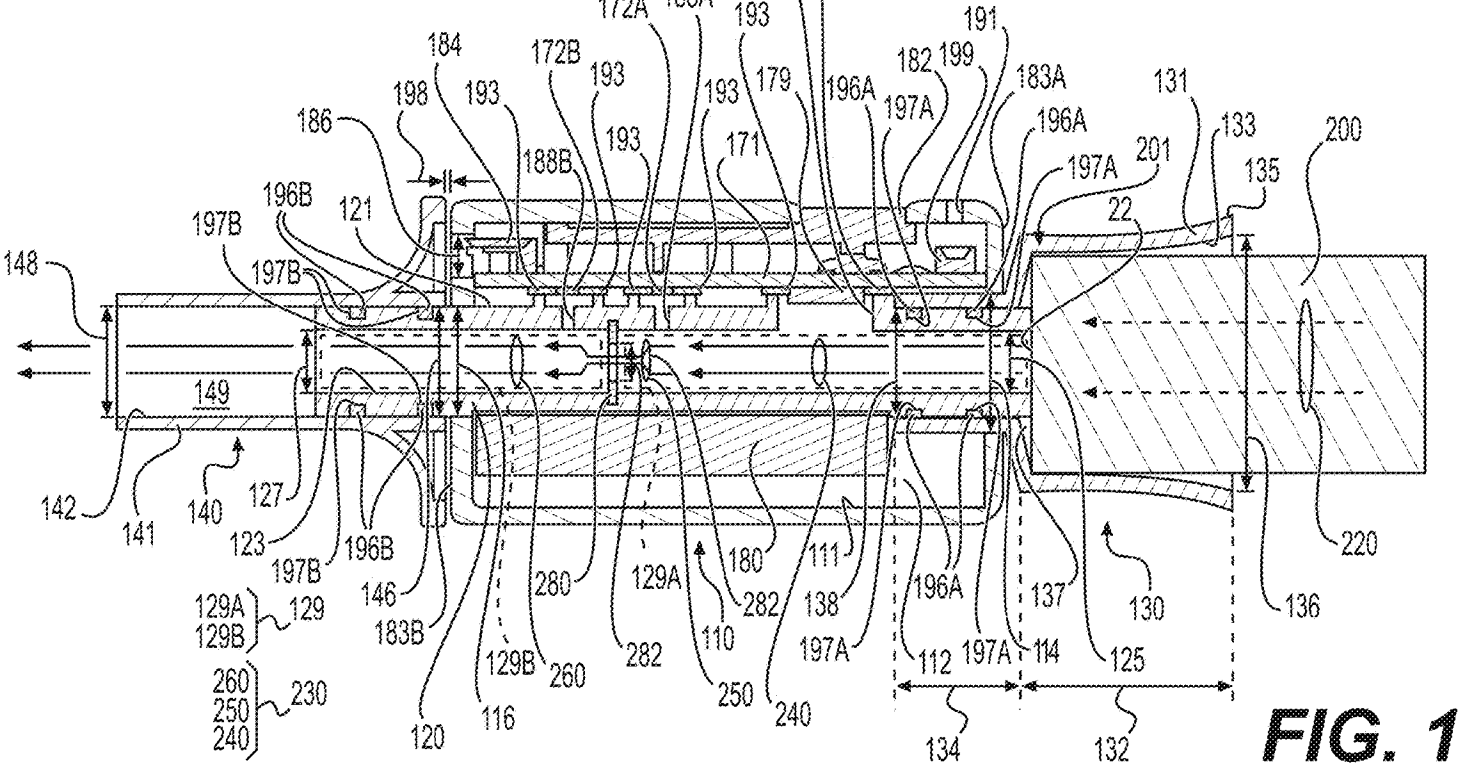
FIG. 1B is a cross-sectional side view of a region A of the assembly of FIG. 1A according to some example embodiments.
Figure 1C:
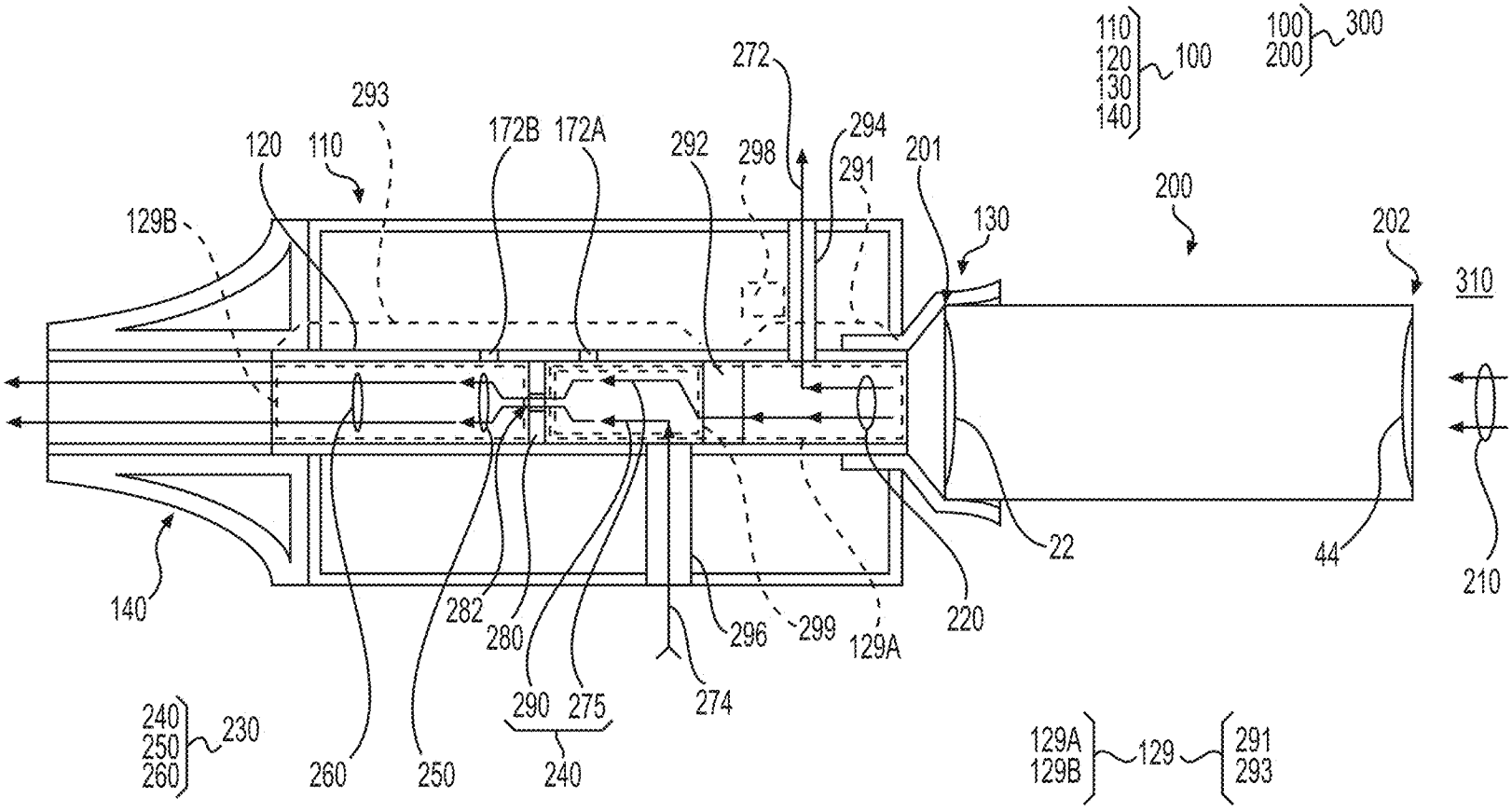
FIG. 1C is a cross-sectional view of an assembly according to some example embodiments.

FIG. 1A is a side view of an assembly that includes a sensor apparatus and external tobacco element according to some example embodiments. FIG. 1B is a cross-sectional side view of a region A of the assembly of FIG. 1A according to some example embodiments. FIG. 1C is a cross-sectional view of an assembly according to some example embodiments.

Referring to FIGS. 1A-1B, in some example embodiments, the sensor apparatus 100 may include a housing 110, a conduit structure 120, an inlet structure 130, and an outlet structure 140. An inner surface 111 of the housing 110 may define an internal space 112 in which various elements of the sensor apparatus 100 are located. In some example embodiments, including the example embodiments shown in FIGS. 1A-1B, the housing 110 may be a multi-piece assembly of two or more housing pieces that are coupled together via coupling of connector elements 194 to form the housing 110. As shown in FIG. 1A, the connector elements 194 may be screw connectors, but in some example embodiments the connector elements 194 may be any connector elements that may couple two or more separate pieces of a housing together to form a housing 110. In some example embodiments, the housing 110 may be a unitary piece of material, such that connector elements 194 may be absent from the assembly 300.

In some example embodiments, including the example embodiments shown in FIG. 1B, the conduit structure 120 may be a cylindrical structure having an outer surface 121, an inner surface 123, an inlet opening 125, and an outlet opening 127. The inner surface 123 may define a conduit 129 extending between the inlet opening 125 and the outlet opening 127. In some example embodiments, including the example embodiments shown in FIG. 1B, the conduit 129 may be partitioned by an orifice structure 280 into separate conduit portions 129A, 129B that are at least partially defined by one or more elements of the conduit structure 120.

In some example embodiments, including the example embodiments shown in FIG. 1B, the conduit structure 120 may extend through the internal space 112 of the housing 110 between opposing housing openings 114, 116 at opposite ends 183A, 183B of the housing 110. In some example embodiments, including the example embodiments shown in FIG. 1B, the internal space 112 may be an annular space that is defined between an inner surface 111 of the housing 110 and an outer surface 121 of the conduit structure 120. However, it will be understood that, in some example embodiments, the internal space 112 that is defined by the inner surface 111 of the housing 110 may be non-annular.

The inlet structure 130 includes a housing 131, having an inner surface 133 and an outer surface 135, that defines an inlet conduit 137 extending through an interior of the inlet structure 130 between an inlet opening 136 and an outlet opening 138 thereof. In some example embodiments, including the example embodiments shown in FIG. 1B, the inlet structure 130 may include a first portion 132 and a second portion 134. As shown in FIG. 1B, the first portion 132 may be configured to connect with an outlet end 201 of an external tobacco element 200 via inlet opening 136, such that aerosol may be drawn from the external tobacco element 200 into the inlet conduit 137. As further shown in FIG. 1B, the second portion 134 may be configured to connect with the conduit structure 120. In some example embodiments, including the example embodiments shown in FIG. 1B, the first and second portions 132, 134 of the inlet structure 130 may have different diameters, where the first portion 132 has a diameter that corresponds to a diameter of the external tobacco element 200 and the second portion 134 has a diameter that corresponds to a diameter of the conduit structure 120, and where the diameter of the first portion 132 may be greater than the diameter of the second portion 134. However, it will be understood that example embodiments are not limited thereto. For example, the first portion 132 and the second portion 134 may have a similar or same diameter. In another example, the diameter of the first portion 132 may be less than the diameter of the second portion 134.

In some example embodiments, including the example embodiments shown in FIG. 1B, the second portion 134 may be configured to extend around an outer surface 121 of the conduit structure 120, but example embodiments are not limited thereto. For example, the second portion 134 may extend into the conduit 129 such that the inner surface 123 of the conduit structure 120 extends around the second portion 134. In some example embodiments, inlet conduit 137 is in fluid communication with conduit 129, and aerosol that is drawn into the inlet conduit 137 from the external tobacco element 200 may be further drawn into the conduit 129 from the inlet conduit 137. In some example embodiments, the inlet structure 130 may be configured to establish a generally airtight seal between the outlet end 201 of the external tobacco element 200 and the conduit structure 120. Aerosol drawn into the inlet conduit 137 from the external tobacco element 200 may be further drawn into the conduit 129 of the conduit structure 120.

In some example embodiments, including the example embodiments shown in FIG. 1B, the inlet structure 130 housing 131 may comprise a flexible material that has a first portion 132 that flares in diameter towards the inlet opening 136 and is configured to flex to accommodate and establish a generally airtight seal, via friction fit, with various external tobacco elements 200 that may have different sizes. Accordingly, the versatility of the sensor apparatus 100 to couple with external tobacco elements 200 having different sizes and/or diameters may be improved, thereby improving the utility of the sensor apparatus 100.

In some example embodiments, including the example embodiments shown in FIGS. 1A-1B, the inlet structure 130 is configured to be detachably connected to the external tobacco element 200, such that the external tobacco element 200 may be detached from the sensor apparatus 100 and/or may be swapped for another, separate external tobacco element 200 in assembly 300. But, example embodiments are not limited thereto. For example, in some example embodiments, the external tobacco element 200 may be fixed to the inlet structure 130, for example via an adhesive binding the inner surface 133 of the inlet structure 130 to an outer surface of the external tobacco element 200.

In some example embodiments, the conduit structure 120 may be connected to the inlet structure 130 via engagement of plug connector elements 196A that extend from an inner surface 133 of the inlet structure 130 with complementary receptacle connector elements 197A that extend around an outer surface 121 of the conduit structure 120, in order to more firmly connect the inlet structure 130 and the conduit structure 120 together. It will be understood that in some example embodiments the plug connector elements 196A may protrude from the outer surface 121 of the conduit structure 120 and may engage with complementary receptacle connector elements 197A that extend around an inner surface 133 of the inlet structure 130.

It will be understood that, in some example embodiments, the plug connector elements 196A and/or the receptacle connector elements 197A may be absent from the sensor apparatus 100, such that the conduit structure 120 may be connected to the inlet structure 130 via friction fit between the conduit structure 120 and the inlet structure 130, adhesive bonding between the conduit structure 120 and the inlet structure 130, engagement of one or more different connector elements between the inlet structure 130 and the conduit structure 120, some combination thereof, or the like.

The outlet structure 140 may include an outlet structure housing 141 having an inner surface 142 that defines an outlet conduit 149 extending through an interior of the outlet structure 140 between an inlet opening 146 and an opposite outlet opening 148. The outlet structure 140 may couple with the conduit structure 120 so that the outlet conduit 149 is in fluid communication with conduit 129. In some example embodiments, the inlet structure 130, the outlet structure 140, or the inlet structure 130 and the outlet structure 140 may be absent from sensor apparatus 100. In some example embodiments, the inlet opening 125 of the conduit structure 120 may be configured to directly connect with an outlet end 201 of an external tobacco element 200.

In some example embodiments, the conduit structure 120 may be connected to the outlet structure 140 via engagement of plug connector elements 196B that extend from an inner surface 142 of the outlet structure 140 with complementary receptacle connector elements 197B that extend around an outer surface 121 of the conduit structure 120, in order to more firmly connect the outlet structure 140 and the conduit structure 120 together. It will be understood that in some example embodiments the plug connector elements 196B may protrude from the outer surface 121 of the conduit structure 120 and may engage with complementary receptacle connector elements 197B that extend around an inner surface 142 of the outlet structure 140.

It will be understood that, in some example embodiments, the plug connector elements 196B and/or the receptacle connector elements 197B may be absent from the sensor apparatus 100, such that the conduit structure 120 may be connected to the outlet structure 140 via friction fit between the conduit structure 120 and the outlet structure 140, adhesive bonding between the conduit structure 120 and the outlet structure 140, engagement of one or more different connector elements between the outlet structure 140 and the conduit structure 120, some combination thereof, or the like.

In some example embodiments, including the example embodiments shown in FIGS. 1A-1B, the inlet structure 130 and the outlet structure 140 may each be configured to be detachably connected to the conduit structure 120, but example embodiments are not limited thereto. For example, the inlet structure 130 may be fixed to the conduit structure 120 via an adhesive material. In another example, the outlet structure 140 may be fixed to the conduit structure 120 via an adhesive material.

In some example embodiments, the conduit structure 120, the inlet structure 130, the outlet structure 140, a sub-combination thereof, or a combination thereof may form part of a unitary piece of material, instead of an assembly of two or more coupled elements as shown in at least FIG. 1B.

As shown in FIG. 1B, in some example embodiments, the sensor apparatus 100 may include pressure sensor devices 172A, 172B, control circuitry 171, interface device 184, temperature sensor device 179, a power supply 180, and a feedback device 199. One or more of the pressure sensor devices 172A, 172B, control circuitry 171, interface device 184, temperature sensor device 179, power supply 180, and feedback device 199 may be located in the internal space 112 defined by the housing 110. However, it will be understood that one or more of these elements may be located in a different portion of the sensor apparatus 100. In some example embodiments, the pressure sensor devices 172A, 172B, control circuitry 171, temperature sensor device 179, interface device 184, power supply 180, feedback device 199, a sub-combination thereof, or a combination thereof may be absent from the sensor apparatus 100. The control circuitry 171 may include a printed circuit board as shown in FIG. 1B, a bus, wiring, a sub-combination thereof, or a combination thereof. In some example embodiments, the control circuitry 171 may include one or more memory devices, one or more processor devices, one or more communication interfaces, a sub-combination thereof, or a combination thereof. The one or more communication interfaces may include a wired communication interface, a wireless communication interface, a sub-combination thereof, or a combination thereof.

As shown in FIG. 1B, in some example embodiments, the housing 110 includes a port 186 extending therethrough that establishes fluid communication between interface device 184 and an exterior of the housing 110. The interface device 184 may be coupled to the port 186, and port 186 may expose the interface device 184, such that the interface device 184 may be accessible, from an exterior of the housing 110, through port 186. In addition, the outlet structure 140 may be configured to be detachable from the conduit structure 120 to expose the port 186, and thus the interface device 184, to an exterior of the housing 110. For example, in some example embodiments, the interface device 184 may be a Universal Serial Bus (USB) connector interface that is accessible via port 186 and may be reversibly covered or exposed by the detachable outlet structure 140 detachably connecting with the conduit structure 120.

In some example embodiments, including the example embodiments shown in FIG. 1B, the outlet structure 140 may be configured to be connected to the conduit structure 120 such that an air gap 198 is established between the outlet structure 140 and the housing 110. In some example embodiments, the outlet structure housing 141 may comprise a flexible material, and the air gap 198 may enable flexing of the outlet structure 140. In some example embodiments, the outlet structure 140 may be configured to be connected to the conduit structure 120 such that the air gap 198 therebetween is absent.

In some example embodiments, the interface device 184 be a communication interface for the sensor apparatus 100 and may be configured to enable information to be communicated between the sensor apparatus 100 and an external device via a communication link. In some example embodiments, the interface 184 is a communication interface that is a wireless network communication interface that is configured to enable information to be communicated between the sensor apparatus 100 and an external device via a communication link that is a wireless network communication link. In some example embodiments, the interface device 184 is a power supply interface that is configured to couple with an external power source to enable the power supply 180 to be charged or recharged with stored electrical power. In some example embodiments, the interface device 184 may include both a communication interface and a power supply interface.

In some example embodiments, the port 186 may extend through a portion of the housing 110 that is not configured to be covered by the outlet structure 140, such that the port 186 may be exposed even when the outlet structure 140 is connected.

In some example embodiments, the port 186 may be absent from sensor apparatus 100, and the interface device 184 may be a wireless network communication interface that is configured to establish a wireless network communication link with one or more external devices. In some example embodiments, the sensor apparatus 100 may include a power interface and a separate communication interface, where the power interface is configured to be electrically coupled to an external power supply to enable power to be supplied to the power supply 180, and where the communication interface, which may be a wired communication interface and/or a wireless communication interface, may be configured to establish a communication link with an external device.

In some example embodiments, including the example embodiments shown in FIG. 1B, the pressure sensor devices 172A, 172B may be in hydrodynamic contact with separate, respective conduit portions 129A, 129B of the conduit 129. Accordingly, the pressure sensor devices 172A, 172B may be configured to measure a local pressure of aerosol at a separate, respective conduit portion 129A, 129B of the conduit 129 and thus may each be configured to generate sensor data indicating a pressure of an instance of aerosol drawn through a separate, respective conduit portion 129A, 129B of the conduit 129. It will be understood that, in some example embodiments, a pressure sensor device may be configured to generate sensor data that may be processed by a processor to enable the processor to determine a magnitude of the local aerosol pressure. In some example embodiments, each pressure sensor device 172A, 172B may be a microelectromechanical system (MEMS) sensor.

As shown in FIG. 1B, the conduit structure 120 may define conduits 188A, 188B that extend between separate conduit portions 129A, 129B of the conduit 129 and respective pressure sensor devices 172A, 172B, thereby establishing hydrodynamic contact between the pressure sensor devices 172A, 172B and respective conduit portions 129A, 129B. As shown in FIG. 1B, the pressure sensor devices 172A, 172B may be connected to the control circuitry 171, and the conduit structure 120 may be coupled to the control circuitry 171 to enclose the pressure sensor devices 172A, 172B in separate, respective conduits 188A, 188B. As further shown in FIG. 1B, one or more gasket structures 193, which may include adhesive material, may establish a seal between the conduit structure 120 and the control circuitry 171 to enclose the pressure sensor devices 172A, 172B within the conduits 188A, 188B.

It will be understood that, in some example embodiments, the conduits 188A, 188B may be established by multiple structures that are coupled to the conduit structure 120 to enclose the pressure sensor devices 172A, 172B.

In some example embodiments, the temperature sensor device 179 that is configured to measure a temperature at conduit portion 129A. It will be understood, however, that in some example embodiments the temperature sensor devices 179 may measure a temperature at conduit portion 129B and/or conduit portion 129A. The temperature sensor devices 179 may be coupled to control circuitry 171 and may be in thermal communication with the conduit 129 via conduit 195, where the conduit 195 may be defined by conduit structure 120. Accordingly, the temperature sensor device 179 may be configured to measure a temperature of aerosol in the conduit 129.

In some example embodiments, the sensor data generated by the temperature sensor device 179 may be processed to determine whether the external tobacco element 200 is depleted below a threshold level. As an external tobacco element 200 of some example embodiments combusts tobacco material included therein, the external tobacco element 200 may be progressively depleted. As the external tobacco element is progressively depleted, a temperature of the generated aerosol 220 that is drawn into the sensor apparatus 100 may increase or decrease. Accordingly, the sensor data generated by the temperature sensor device 179 may be processed to determine a temperature of the aerosol 240, and the temperature may be compared with a threshold temperature that is associated with depletion of the external tobacco element 200. The threshold temperature value may be stored in a memory, which may be included in the sensor apparatus 100 and/or an external device. Based on a determination that the determined temperature of the aerosol 240 is past the threshold temperature (e.g., greater than or less than the threshold temperature), a determination may be made that the external tobacco element 200 is depleted, and an indication of said depletion may be provided via one or more interface devices, including a light indicator, a display screen, or the like.

The sensor apparatus 100 may include an initialization interface 182 that is configured to selectively initialize the sensor apparatus 100 based on adult tobacco consumer ("ATC") interaction with the initialization interface 182.

Still referring to FIG. 1B, the conduit structure 120 may include an orifice structure 280 within the conduit 129. The orifice structure 280 may include an orifice 282 having a reduced diameter relative to the diameter of the conduit 129, such that the conduit structure 120 is configured to direct aerosol drawn through the conduit 129 from the external tobacco element 200 to pass through the orifice 282 towards the outlet opening 148 of the outlet structure 140. The orifice structure 280 may include any flow orifice or fluid orifice structure that is known in the relevant art, including an orifice plate, a Venturi Nozzle, some combination thereof, or the like. In some example embodiments, the orifice structure 280 may include multiple orifices 282.

Still referring to FIGS. 1A-1B, in some example embodiments, the sensor apparatus 100 may couple with external tobacco element 200 to form an assembly 300. The external tobacco element 200 may include one or more inlets 44 at an inlet end 202 of the external tobacco element 200 and one or more outlets 22 at an outlet end 201 of the external tobacco element 200. The external tobacco element 200 may include a cigarette, a cigar, a cigarillo, or the like. In some example embodiments, the external tobacco element 200 may be configured to enable ambient air 210 to be drawn into the external tobacco element 200 from an ambient environment 310 via the one or more inlets 44. Generated aerosol 220 may be generated in the interior of the external tobacco element 200, for example based on combustion of a tobacco material in the presence of the ambient air 210, non-combustion heating of a tobacco material in the presence of the ambient air 210, or a combination thereof. In some example embodiments, the generated aerosol 220 may be referred to as smoke. The generated aerosol 220 may be drawn through the one or more outlets 22 and thus out of the external tobacco element 200. As described herein, an aerosol may include a mixture of the generated aerosol 220 and one or more other gases, including ambient air 210.

As shown in FIG. 1B, in some example embodiments, the generated aerosol 220 may be drawn through the one or more outlets 22 and into the conduit 129 of the conduit structure 120, via inlet conduit 137. The aerosol drawn through at least a portion of conduit 129 and further through the outlet opening 148, which may partially or entirely comprise the generated aerosol 220, is referred to herein as a drawn aerosol 230.

Still referring to FIG. 1B, in some example embodiments, the generated aerosol 220 that is drawn from the external tobacco element 200 and into the conduit 129 at the inlet opening 125 of the conduit 129 may be drawn through the first conduit portion 129A of the conduit 129 as aerosol 240. As shown in FIG. 1B, the aerosol 240 may be considered to be the drawn aerosol 230 in the first conduit portion 129A. The drawn aerosol 230 may, subsequently to passing through the first conduit portion 129A as aerosol 240, be drawn through the orifice 282 of orifice structure 280 as aerosol 250. The drawn aerosol 230, upon being drawn through the orifice 282 as aerosol 250, may be further drawn through the second conduit portion 129B of the conduit 129 to the outlet 148 as aerosol 260.

In some example embodiments, the pressure sensor device 172A may be configured to generate sensor data that, when processed, provides an indication of the pressure of aerosol 240 in the first conduit portion 129A of the conduit 129, and the sensor device 172B may be configured to generate sensor data that, when processed, provides an indication of the pressure of aerosol 260 in the second conduit portion 129B of the conduit 129. In some example embodiments, the flow rate of drawn aerosol 230 through a sensor apparatus 100 that includes orifice structure 280 having orifice 282 may be determined based on application of the difference between the pressures indicated by the respective instances of sensor data generated by pressure sensor devices 172A, 172B. Various known methods may be used. For example, the difference between the pressures indicated by the respective instances of sensor data generated by pressure sensor devices 172A, 172B may be applied to Equation (1) below as a pressure differential "ΔP" to determine the value of a volumetric flow rate "Q" of the drawn aerosol 230 through the sensor apparatus 100. In Equation (1) below, "ε" is an expansion coefficient associated with compressible media (e.g., gases), "C" is a discharge coefficient, "d" is the internal orifice diameter of orifice 282 under operating conditions, "β" is a ratio of the diameter of the orifice 282 to the diameter of conduit 129, and "$\rho_t$" is a density of the aerosol 240 in the conduit portion 129A.

$$Q = \frac{C}{\sqrt{1-\beta^4}} \cdot \varepsilon \cdot \frac{\pi}{4} \cdot d^2 \cdot \sqrt{2\rho_1 \Delta P} \tag{1}$$

Assuming that the values of "C", "β", "ε", "$\rho_t$", and "d" are constant values, the flow rate Q may be calculated based on the pressure differential "ΔP" and a calculated constant value "K" that is derived from one or more of "C", "β", "ε", "$\beta_t$", and "d" as shown in equation (2) below:

$$Q = K \cdot \sqrt{\Delta P}, \text{ where} \tag{2}$$

$$K = \frac{C}{\sqrt{1-\beta^4}} \cdot \varepsilon \cdot \frac{\pi}{4} \cdot d^2 \cdot \sqrt{2\rho_1}$$

It will be understood that the values of "C", "β", "ε", "$\mu_1$", and "d" may be determined through well-known, empirical methods. In some example embodiments, the values of "C", "β", "ε", "$\rho_1$", and "d", the value of constant value "K", a sub-combination thereof, or a combination thereof may be stored in a memory and accessed as part of calculating the value of "Q" according to either Equation (1) or Equation (2).

In some example embodiments, one or more of the aforementioned constant values may vary according to the local temperature and/or pressure. Accordingly, the value of K at any given time may be calculated and/or estimated based on the calculated value of ΔP at the same time. In some example embodiments, the temperature sensor device 179 may be configured to measure a local temperature relative to the sensor apparatus 100, and the value of the value of K at any given time may be determined based on the measured local temperature. For example, in some example embodiments, the value of K may be determined based on applying a temperature determined based on sensor data generated by the temperature sensor device 179 to a look up table that associates temperatures with corresponding values of K.

In some example embodiments, a flow rate "Q" and/or constant value "K" may be determined based on accessing a look up table that includes a set of pressure differential ΔP values and associated drawn aerosol 230 flow rate Q values and/or constant K values. The look up table may be generated separately via well-known empirical techniques, for example via drawing various instances of known flow rates of drawn aerosol 230 through the conduit 129 and calculating the corresponding pressure differentials associated with the known flow rates of drawn aerosol 230 to calculate drawn aerosol 230 flow rate Q values, and/or based on drawing various instances of known flow rates of drawn aerosol 230 through the conduit 129 with known pressure differentials and at various known temperatures to calculate corresponding constant K values.

In some example embodiments, the sensor apparatus 100, including the orifice structure 280, may be configured to enable the pressure sensor devices 172A, 172B to generate sensor data that may be processed to enable the determination of a volumetric flow rate Q of the drawn aerosol through the conduit 129 that is equal to or greater than about 5 cubic centimeters per minute.

It will be understood that, while the above description relates to the determination of a volumetric flow rate Q of the drawn aerosol 230 through the conduit 129 based on a determined pressure differential, a mass flow rate M of the drawn aerosol 230 through the conduit 129 may be determined via similar methodology. Such methodology may include use of a look up table, via application of pressure differential values to one or more well-known algorithms for determining mass flow rate based on further application of known and stored constant values associated with the drawn aerosol 230 and/or conduit 129, a sub-combination thereof, a combination thereof, or the like.

In some example embodiments, the total amount of an instance of aerosol that is drawn through at least a portion of conduit 129 within any given period of time may be determined simply via known techniques for determining total mass and/or total volume of an instance of fluid passing through a conduit within a time period based on determined mass flow rate and/or volume flow rate values for the fluid during the same time period. For example, a total mass or volume of an instance of aerosol drawn through the conduit 129 within a given period of time may be determined based on 1) for each separate determined (mass or volume) flow rate value associated with the period of time, determining a value for the mass or volume of the instance of aerosol based on multiplication of the flow rate value with a particular time segment value associated with the respective flow rate value and 2) determining a sum of the determined mass or volume values. In another example, a total mass or volume of an instance of aerosol drawn through at least a portion of the conduit 129 within a given period of time may be determined based on 1) applying curve fitting and/or regression (using any various type of well-known algorithm, including any polynomial algorithm) to a series of (mass or volume) flow rate values determined at various separate points in time during the period of time to generate an algorithm of flow rate based on time that at least approximates the determined flow rate values and 2) performing mathematical integration of the algorithm over the period of time to determine a total mass or volume value of the instance of aerosol drawn at least partially through the conduit during the period of time. Other suitable methods may be used.

In some example embodiments, the above determinations may be made by one or more elements of control circuitry 171, based on executing a program of instructions that is stored at a memory of the control circuitry 171 and further based on sensor data received from the pressure sensor devices 172A, 172B.

In some example embodiments, the sensor apparatus 100 may generate information based on the sensor data generated by the pressure sensor devices 172A, 172B, where the information indicates a flow rate of an instance of an aerosol through the sensor apparatus 100, a duration of the instance of aerosol being drawn through the sensor apparatus 100, a total amount of the instance of aerosol that is drawn through the sensor apparatus 100, a sub-combination thereof, or a combination thereof. The instance of aerosol as described above may be an instance of drawn aerosol 230, but example embodiments are not limited thereto. For example, the instance of aerosol as described above may be an instance of generated aerosol 220.

In some example embodiments, a flow rate of an instance of generated aerosol 220 may be determined based on determining the flow rate of an instance of drawn aerosol 230 that is drawn through the sensor apparatus 100 in accordance with sensor data generated by the pressure sensor devices 172A, 172B, accessing a look up table that indicates algorithms and/or multipliers associated with the generated aerosol 220, and applying the determined flow rate of drawn aerosol 230 to the indicated algorithms and/or multipliers to determine the flow rate of the instance of generated aerosol 220. The look up table may be generated empirically via well-known techniques.

Based on the aforementioned determinations, the actual flow rate and/or total amount of an instance of generated aerosol 220 that is included in a given instance of drawn aerosol 230 may be determined.

In some example embodiments, the information that may be generated based on sensor data generated by pressure sensor devices 172A, 172B of a sensor apparatus 100, may be referred to as topography information. The topography information may include a set of information indicating properties of one or more instances of aerosol drawn through a sensor apparatus 100. The properties of one or more instances of aerosol drawn through a sensor apparatus may be referred to herein as aerosol properties.

In some example embodiments, a set of information may indicate time-variation of one or more aerosol properties in association with one or more instances of aerosol drawn through the sensor apparatus 100 over a period of time. The one or more aerosol properties may include a flow rate, amount, time of day, and/or duration of various instances of aerosol drawn through the sensor apparatus 100 over a given period of time. A set of information indicating time-variation of one or more aerosol properties associated with a plurality of instances of aerosol drawn through the sensor apparatus 100 over a period of time may be referred to herein as an aerosol draw pattern.

In some example embodiments, an aerosol draw pattern may indicate a historical time-variation of one or more properties associated with a plurality of instances of aerosol drawn through the sensor apparatus 100 over a period of time. Such historical time-variation may be referred to herein as a historical aerosol draw pattern. A historical aerosol draw pattern may be generated based on storing and/or aggregating information generated over time at the sensor apparatus 100 in response to one or more instances of aerosol being drawn through the sensor apparatus 100. Such aggregated information may include topography information associated with one or more previous instances of aerosol that were drawn through the sensor apparatus 100. Each separate set of information associated with a separate previous instance of aerosol drawn through the sensor apparatus 100 may be stored, at the sensor apparatus 100 and/or the computing device 302, as a portion of an instance of topography information associated with the sensor apparatus 100 and/or an ATC supported by the sensor apparatus 100 and/or computing device 302. The topography information, including the one or more set of information associated with previous instances of aerosol drawn through the sensor apparatus 100 may be processed to determine an aerosol draw pattern associated with at least the one or more previous instances of aerosol, where a portion of the aerosol draw pattern that is associated with the one or more previous instances of aerosol is referred to as the historical aerosol draw pattern.

As described herein, an instance of aerosol being drawn through the sensor apparatus 100 may be determined to have started based on a determination, upon processing of information associated with sensor data generated by the pressure sensor devices 172A, 172B, a magnitude of a pressure differential between the separate pressures measured by the separate pressure sensor devices 172A, 172B at least meets a particular threshold magnitude. In response to such a determination, a start time of the drawing of the instance of aerosol may be determined as the time at which the pressure differential at least meets the particular threshold magnitude. An initial flow rate of aerosol through the sensor apparatus 100 in associated with the instance of aerosol being drawn through the sensor apparatus 100 may be determined based on processing information indicating a pressure differential at the start of the instance of aerosol, information indicating an average pressure differential within a short period of time following the start of the instance of aerosol, or a combination thereof.

In some example embodiments, an instance of aerosol may be determined to be ended in response to a determination that the magnitude of the pressure differential between the separate pressures measured by the separate pressure sensor devices 172A, 172B, having previously exceeded the particular threshold magnitude at the start of the instance, subsequently falls to equal or be less than the particular threshold magnitude. The time at which the pressure differential falls to equal or be less than the particular threshold magnitude may be determined to be the end time of the instance of aerosol being drawn through the sensor apparatus 100. Subsequent determined rises of the pressure differential to exceed the particular threshold magnitude may be determined to be indications of a start of a separate, subsequent instance of aerosol being drawn through the sensor apparatus 100.

In some example embodiments, an aerosol draw pattern may indicate a projection of one or more aerosol properties associated with a presently-ongoing instance of aerosol drawn through the sensor apparatus 100 upon a projected completion of the presently-ongoing instance of aerosol. The projection may be based upon a set of information that is recorded by the pressure sensor devices 172A, 172B at a detected start of the presently-ongoing instance of aerosol and information associated with a historical aerosol draw pattern. For example, the projection may be based on a determination of an initial flow rate of drawn aerosol 230 through the sensor apparatus 100 at the determined start time of an instance of the drawn aerosol 230 being drawn through the sensor apparatus 100 and a determined average duration of one or more previous instances of aerosol being drawn through the sensor apparatus 100, as indicated by processing a historical aerosol draw pattern. Accordingly, an aerosol draw pattern may indicate a projection of a total amount of an aerosol to be drawn through the sensor apparatus 100 upon completion of the presently-ongoing instance of aerosol. Such a projection may be referred to herein as a projected aerosol draw pattern, and a portion of the aerosol draw pattern that is associated with a presently-ongoing instance of aerosol being drawn through the sensor apparatus 100 may be referred to as the projected aerosol draw pattern. Accordingly, it will be understood that in some example embodiments, within a given period of time, an aerosol draw pattern may include both a historical aerosol draw pattern, based on one or more previous instances of aerosol, and a projected aerosol draw pattern, based on a presently-ongoing instance of aerosol.

In some example embodiments, the sensor apparatus 100 enables the generation of real-time and/or near-real-time streams of information regarding at least the drawn aerosol 230 that is through the sensor apparatus 100. Such real-time and/or near-real-time streams of information may be used, by the sensor apparatus 100 and/or one or more computing devices communicatively coupled to the sensor apparatus 100, to generate real-time and/or near-real-time displays of information associated with an aerosol draw pattern corresponding to one or more instances of aerosol drawn through a sensor apparatus 100 to an ATC supported by a computing device, sensor apparatus 100, or a combination thereof, thereby enabling improved awareness by the ATC of one or more properties associated with one or more aerosol draws.

In some example embodiments, the sensor apparatus 100 enables the generation of aerosol draw pattern information based on utilizing a relatively compact sensor apparatus structure that avoids including a sensor device that directly impinges and/or obstructs even a portion of the fluid conduit through which fluid is drawn. In some example embodiments, the sensor apparatus 100 may utilize an interface devices 184 that includes a wireless communication interface to communicate information associated with one or more instances of aerosol drawn through the sensor apparatus 100. The sensor apparatus 100 may enable the real-time or near real-time generation, monitoring, and/or analysis of topography information that provide an improved indication of properties associated with one or more instances of aerosol drawn through the external tobacco element 200 in the absence of the sensor apparatus 100. Providing such indications in real-time or near real-time may further enable providing improved awareness of the characteristics of instance of aerosol drawn through the sensor apparatus 100 and may further enable improved, real-time or near real-time control of the flow rate, duration, and/or amount of one or more instances of aerosol through the sensor apparatus 100 over a period of time in accordance with one or more aerosol draw patterns.

Still referring to FIG. 1B, in some example embodiments, the sensor apparatus 100 may be configured to communicate information to an external, remotely-located computing device via the interface device 184. In some example embodiments, the interface device 184 may include a communication interface that is configured to communicate, to an external computing device via a communication link, information that includes a sensor data stream that provides a real-time indication of the flow of one or more instances of aerosol drawn through the sensor apparatus 100, where the information may include sensor data generated by pressure sensor device 172A, pressure sensor device 172B, temperature sensor device 179, a sub-combination thereof, or a combination thereof. The communication interface may be a wireless network communication interface and the communication link may be a wireless network communication link. The information may include processed information generated at sensor apparatus 100 based on sensor data generated by pressure sensor device 172A, pressure sensor device 172B, temperature sensor device 179, a sub-combination thereof, or a combination thereof. In some example embodiments, the interface device 184 may communicate, via a communication link to an external device, a sensor data stream providing a real-time or near-real-time indication of at least one of a flow rate of one or more instances of aerosol through the conduit 129, a pressure differential, a total to-date amount of an instance of aerosol drawn through the conduit 129 over a period of time, a temperature differential, a sub-combination thereof, or a combination thereof.

As described herein, where one or more instances of an aerosol drawn through the sensor apparatus 100 are described, an aerosol draw pattern relating to one or more instances of aerosol drawn through the sensor apparatus 100 are described, a time-variation of a cumulative amount of an aerosol included in one or more instances of aerosol drawn through the sensor apparatus 100, some combination thereof, or the like, the aerosol may include one or more of drawn aerosol 230 and generated aerosol 220 as described herein. In some example embodiments, the aerosol may include one or more of drawn aerosol 230, generated aerosol 220, bypass aerosol 272, bypass air 274, remainder generated aerosol 290, some combination thereof, or the like.

Still referring to FIG. 1B, the sensor apparatus 100 may include a feedback device 199 that is configured to generate a feedback signal that is observable from an exterior of the sensor apparatus 100 through a port 191 in the housing 110. The feedback signal may be an audio signal, a visual signal, a vibration signal, a haptic feedback signal, etc., a sub-combination thereof, or a combination thereof. It will be understood that, in some example embodiments, port 191 may be absent from the housing 110, and the feedback device 199 may be on an outer surface of the housing 110 and/or may at least partially extend through the housing 110 to the outer surface, such that the feedback device 199 may be observable from an exterior of the sensor apparatus 100.

In some example embodiments, the feedback device 199 may be controlled to generate a feedback signal. In some example embodiments, as described further below, the feedback device 199 may generate a particular feedback signal of a plurality of feedback signals based on a determination of whether an aerosol draw pattern of one or more instances of aerosol that are drawn through the sensor apparatus 100 exceed a threshold aerosol draw pattern, where the determination may be made based on processing information associated with sensor data generated by the pressure sensor devices 172A, 172B of the sensor apparatus 100. Accordingly, in some example embodiments, the sensor apparatus 100 may be configured to provide feedback to an adult tobacco consumer (ATC) regarding whether a pattern of one or more instances of aerosol that are drawn through at least a portion of the sensor apparatus 100 conforms to, or exceeds, a threshold aerosol draw pattern, based on generating one or more particular feedback signals. The threshold aerosol draw pattern may be associated with a level of desired generated aerosol 220 drawing through the outlet 148, such that the feedback signals generated by the feedback device 199 may enable an ATC to monitor one or more instances of aerosol drawn through the sensor device in relation to the level of desired generated aerosol 220 drawing.

Still referring to at least FIG. 1A-1B, in some example embodiments, a sensor apparatus 100 that includes pressure sensor devices 172A, 172B and an interface device 184 that includes a communication interface may provide a relatively compact structure that is configured to generate information providing real-time or near-real-time data indication of a flow rate of aerosol drawn from the external tobacco element 200 and through the sensor apparatus 100. In some example embodiments, based at least in part upon the pressure sensor devices 172A, 172B of the sensor apparatus 100 being in hydrodynamic communication with the conduit 129 and not at least partially obstructing the conduit 129, the structure of the sensor apparatus 100 may enable monitoring of one or more instances of aerosol drawn from the external tobacco element 200 while reducing and/or minimizing any effects of the sensor apparatus itself 100 upon properties of the one or more instances, for example by not limiting the maximum flow rate of aerosol through the conduit 129 to be less than the maximum flow rate of generated aerosol 220 that may be drawn out of the external tobacco element 200 in the absence of a sensor apparatus 100 being coupled to the external tobacco element 200.

In some example embodiments, the interface device 184 may include a wireless network communication interface and thus may enable reduced influence of the sensor apparatus 100 upon instances of aerosol that may be drawn from the external tobacco element 200. The relatively compact structure of the sensor apparatus 100 and reduced influence of the sensor apparatus 100 upon the flow of aerosol drawn from the external tobacco element 200 may further enable manipulation and/or operation of the sensor apparatus 100 and coupled external tobacco element 200 with reduced physical and/or operational limitations and/or restrictions. In example embodiments, properties may include a flow rate of one or more instances of aerosol, a duration of the one or more instances of aerosol being drawn through the sensor apparatus, a total amount of each instance of aerosol, a time of day at which each instance of aerosol is drawn through the sensor apparatus, a sub-combination thereof, or a combination thereof. Such properties may be referred to herein as aerosol properties, and a time-variation of one or more such properties over a period of time, based on one or more instances of aerosol being drawn through the sensor apparatus over the period of time, may be referred to herein as an aerosol draw pattern. An aerosol draw pattern relating to one or more instances of aerosol that are drawn through at least a portion of the sensor apparatus 100 may correspond to an aerosol draw pattern relating to one or more instances of generated aerosol 220 drawn from the external tobacco element 200 in the absence of the external tobacco element 200 being coupled to the sensor apparatus 100.

As described herein, an aerosol draw pattern relating to one or more instances of aerosol drawn through the sensor apparatus 100 may form at least a portion of topography information. The information generated by the sensor apparatus 100, which may be associated with said sensor data generated by one or more pressure sensor devices 172A, 172B of the sensor apparatus 100, may be processed to generate topography information that indicates one or more aerosol draw patterns relating to one or more instances of aerosol drawn through the sensor apparatus 100. As described herein, the processing of information associated with sensor data to generate topography information associated with the sensor apparatus 100 may be performed by at least one device, where the at least one device is the sensor apparatus 100, a computing device communicatively linked to the interface device 184 of the sensor apparatus 100 via a communication link, or a combination thereof.

As described herein, topography information may be processed to generate a particular feedback control signal to cause the feedback device 199 to generate one or more particular feedback signals to provide feedback regarding whether an aerosol draw pattern of one or more instances of aerosol that are drawn through the sensor apparatus 100 conforms to or exceeds a threshold aerosol draw pattern. Accordingly, such feedback signals may enable manual adjustment of an aerosol draw pattern to at least conform to one or more threshold aerosol draw patterns.

While FIG. 1B shows pressure sensor devices 172A, 172B that are separated from conduit 129 by respective conduits 188A, 188B, it will be understood that, in some example embodiments, including for example the example embodiments shown in FIG. 1C, one of more of the pressure sensor devices 172A, 172B may be located in the conduit structure 120 such that a conduit-proximate surface of each sensor device 172A, 172B is flush with the inner surface 123 of the conduit structure 120 that at least partially defines the conduit 129.

In some example embodiments, the interface device 184 may be a manual interface device that is configured to support interactions between an adult tobacco consumer (ATC) and the sensor apparatus 100. In some example embodiments, the sensor apparatus 100 may be restricted from establishing a communication link with an external device. For example, the interface device 184 may, in some example embodiments, include a display device, one or more buttons, a combination thereof, or the like. In some example embodiments, the interface device 184 may include a touchscreen display device. In some example embodiments, the control circuitry 171 may be configured to generate topography information based on sensor data generated by the pressure sensor devices 172A, 172B and may display some or all of the topography information on a display device of interface device 184. Such a display of topography information may include one or more of the graphs shown in FIGS. 4A and 4B. Some example embodiments may include one or more of these features, and also be able to establish a communication link with an external device.

FIG. 1C is a cross-sectional view of an assembly 300 according to some example embodiments. As shown in FIG. 1C, in some example embodiments, a sensor apparatus 100 may be at least partially similar in structure and configured operation as the sensor apparatus 100 shown in FIGS. 1A-B. Elements of the sensor apparatus 100 shown in FIG. 1C that are the same in structure and/or functional configuration as the similarly-labeled elements of the sensor apparatus 100 shown in FIGS. 1A-1B are not re-described here.

In some example embodiments, topography information may be processed to enable control of the flow rate of one or more aerosols through the sensor apparatus 100. Control of such flow rate may be based upon comparison of a determined aerosol draw pattern of one or more instances of the one or more aerosols drawn through the sensor apparatus 100 with a threshold aerosol draw pattern. Such control may include adjusting the flow rate of one or more instances of aerosol through at least a portion of the sensor apparatus 100 to adjust an aerosol draw pattern to conform to a threshold aerosol draw pattern. Accordingly, in some example embodiments, the topography information that is generated based on sensor data generated by the pressure sensor devices 172A, 172B may enable improved control provided by an assembly 300 that includes the sensor apparatus 100 based on controlling the flow rate of one or more instances of aerosol through at least a portion of the sensor apparatus 100. Such control may be implemented by sensor apparatus 100, a computing device that is external to the sensor apparatus 100 and is communicatively linked to a communication interface of the sensor apparatus 100 via a communication link, or a combination thereof. For example, such control may be implemented by a computing device that is external to the sensor apparatus 100 and is communicatively linked to a wireless network communication interface and/or wired network communication interface of an interface device 184 of the sensor apparatus 100 via a wireless communication link and/or wired communication link.

As shown in FIG. 1C, in some example embodiments, a sensor apparatus 100 may include one or more flow control devices 292, 294, 296, 298 that are configured to adjustably control a flow rate of at least a portion of an instance of generated aerosol 220 through one or more portions of the conduit 129, a flow of an instance of drawn aerosol 230 through one or more portions of the conduit 129, or a combination thereof. The sensor apparatus 100 may be configured to adjustably control the one or more flow control devices 292, 294, 296, 298 to adjustably control the flow of the drawn aerosol 230, generated aerosol 220, or combination thereof through one or more portions of the conduit 129. In some example embodiments, the sensor apparatus 100 may adjustably control the one or more flow control devices 292, 294, 296, 298 based on a feedback control signal that is received at the communication interface of the sensor apparatus 100, which may be included in an interface device 184 thereof, from an external computing device.

In some example embodiments, the adjustable valve device 292 may adjustably control a cross-sectional flow area of at least a limited portion of the conduit 129 to control a flow of the generated aerosol 220, as a flow of remainder generated aerosol 290 that comprises at least a portion of drawn aerosol 230, through at least a portion of the sensor apparatus 100 to outlet opening 148. The remainder generated aerosol 290 may be referred to as a first portion of the generated aerosol 220. The adjustable valve device 292 may be any known adjustable valve device that may adjustably control a flow of a fluid through a conduit, including a ball valve, gate valve, adjustable orifice, or the like.

As shown in FIG. 1C, in some example embodiments, the conduit 129 may be partitioned into an inlet portion 291 and a remainder portion 293 that are each at least partially defined by the adjustable valve device 292, where the inlet portion 291 is defined as a portion of conduit 129 that extends between the adjustable valve device 292 and the inlet opening 125, and the remainder portion 293 is defined as a portion of conduit 129 that extends between the adjustable valve device 292 and the outlet opening 127. In some example embodiments, the portion of conduit portion 129A within the remainder portion 293 may be conduit portion 299, and the pressure sensor device 172A may generate sensor data indicating a pressure of aerosol in conduit portion 299.

In some example embodiments, the adjustable vent device 294 may define and adjustably control a cross-sectional flow area of a bypass vent conduit that branches from the inlet portion 291 of conduit 129 to the ambient environment 310, independently of the remainder portion 293 of conduit 129 that extends to the outlet opening 127. The adjustable vent device 294 may adjustably re-direct at least a portion of the generated aerosol 220 that is drawn into the conduit 129 from the inlet opening 125 to flow into the ambient environment 310 as bypass aerosol 272, independently of being drawn through the remainder portion 293 of the conduit 129 to the outlet opening 148 as at least a portion of drawn aerosol 230. As described herein, the bypass aerosol 272 may be a second portion of the generated aerosol 220. In some example embodiments, the remainder generated aerosol 290 and the bypass aerosol 272 may be separate portions of the generated aerosol 220 that are drawn and/or directed through separate portions of the sensor apparatus 100. The remainder generated aerosol 290 may be a limited portion or an entire portion of the generated aerosol 220. The bypass aerosol 272 may be a limited portion or an entire portion of the generated aerosol 220.

In some example embodiments, the pump device 298 may induce a flow of the bypass aerosol 272 through to the ambient environment 310 to overcome a pressure gradient from the ambient environment 310 to the inlet portion 291 of the conduit 129. The pump device 298 may be any known pump device. For example, the pump device 298 may be a centrifugal pump.

In some example embodiments, the adjustable vent device 294, pump device 298, and adjustable valve device 292 may adjustably restrict a portion of generated aerosol 220 from being drawn through the adjustable valve device 292 and may re-direct said portion of the generated aerosol 220 into the ambient environment 310 through the adjustable vent device 294 and pump device 298 as bypass aerosol 272, thereby at least partially mitigating pressure buildup within the inlet portion 291 of the conduit 129. Accordingly, a limited portion of the generated aerosol 220 may be drawn through the adjustable valve device 292 as remainder generated aerosol 290, such that the drawn aerosol 230 includes a limited portion of the generated aerosol 220. In some example embodiments, an entirety of the generated aerosol 220 may be re-directed to the ambient environment 310 as bypass aerosol 272, such that the drawn aerosol 230 omits remainder generated aerosol 290.

Adjustable intake device 296 may define and adjustably control a cross-sectional flow area of another bypass vent conduit that branches from the ambient environment 310 to the remainder portion 293 of conduit 129, independently of the inlet opening 125. The adjustable intake device 296 may adjustably draw a stream of ambient air from the ambient environment 310 into remainder portion 293 of the conduit 129 as bypass air 274, independently of the external tobacco element 200, inlet portion 291, and/or inlet opening 125 and thus independently of generated aerosol 220 that is drawn into the conduit 129 through the inlet opening 125. The bypass air 274 may, as shown in FIG. 1C, flow through the remainder portion 293 of the conduit 129 as drawn air 275. Thus, the drawn aerosol 230 may include a mixture of the remainder generated aerosol 290 and the drawn air 275, such that the drawn aerosol 230 is diluted of generated aerosol 220, thereby reducing a proportion of drawn aerosol 230 that include generated aerosol 220 and/or remainder generated aerosol 290.

The adjustable intake device 296 and adjustable valve device 292 may adjustably restrict a portion of generated aerosol 220 from passing through the adjustable valve device 292 towards outlet opening 127 and may draw at least some ambient air from the ambient environment 310 into the conduit 129 to replace the portion of generated aerosol 220 that is restricted from passing through the adjustable valve device 292. Accordingly, the drawn aerosol 230 may include an adjustably controlled amount and/or proportion of the remainder generated aerosol 290 that is balanced with drawn air 275 so that the drawn aerosol 230 has a total flow rate that approximates (for example, inclusively between 90% and 110% of) the total flow rate of generated aerosol 220 that is received into conduit 129 through inlet opening 125. Accordingly, the amount of generated aerosol 220 that is included in the drawn aerosol 230, as the remainder generated aerosol 290, may be adjustably controlled without significant variation in flow of the drawn aerosol 230 from the flow of the generated aerosol 220 drawn into the sensor apparatus 100.

The adjustable vent device 294 and the adjustable intake device 296 may each be a one-way valve that is configured to enable only a one-way flow of fluid. For example, the adjustable vent device 294 may be a check valve that is configured to adjustably enable and adjustably control a flow of bypass aerosol 272 that is restricted, based on the structure of the check valve, to flow only from the conduit 129 to the ambient environment 310, and the adjustable intake device 296 may be a check valve that is configured to adjustably enable and adjustably control a flow of bypass air 274 that is restricted, based on the structure of the check valve, to flow only from the ambient environment 310 to the conduit 129.

The sensor apparatus 100 may be configured to, based on operation of the control circuitry 171, adjustably control adjustable valve device 292, adjustable vent device 294, adjustable intake device 296, pump device 298, a sub-combination thereof, or a combination thereof, to adjustably control the amount and/or proportion of generated aerosol 220, that is included in the drawn aerosol 230 as remainder generated aerosol 290. The adjustable valve device 292, adjustable vent device 294, adjustable intake device 296, and/or pump device 298 may be adjustably controlled, based on processing sensor data generated by pressure sensor devices 172A, 172B, to cause the flow rate of remainder generated aerosol 290 to be within a particular margin of a particular flow rate.

In some example embodiments, the sensor apparatus 100 may generate information, and communicate information to an external device, where the information indicates an operating configuration of one or more flow control devices included in the sensor apparatus 100, including one or more of the adjustable flow control devices 292, 294, 296, 298 as described herein, where the determination is based on a configuration generated at the sensor apparatus 100. A flow rate of bypass aerosol 272, bypass air 274, generated aerosol 220, remainder generated aerosol 290, drawn air 275, a sub-combination thereof, or a combination thereof drawn through the sensor apparatus 100 may be determined based on information, generated at the sensor apparatus 100, that indicates the flow rate of an instance of aerosol through the sensor apparatus 100, duration of the instance of aerosol being drawn through the sensor apparatus 100, total amount of the instance of aerosol that is drawn through the sensor apparatus 100, information indicating a configuration of one or more of the adjustable flow control devices 292, 294, 296, 298 concurrently with the instance of aerosol being drawn through the sensor apparatus 100, a sub-combination thereof, or a combination thereof. The instance of aerosol as described above may be an instance of drawn aerosol 230, but example embodiments are not limited thereto. For example, instance of aerosol as described above may be an instance of remainder generated aerosol 290.

In some example embodiments, a flow rate of bypass aerosol 272, bypass air 274, generated aerosol 220, remainder generated aerosol 290, drawn air 275, a sub-combination thereof, or a combination thereof, may be determined based on determining the flow rate of drawn aerosol 230 through the sensor apparatus 100 based on information associated with sensor data generated by the pressure sensor devices 172A, 172B, determining the configurations of the one or more flow control devices 292, 294, 296, 298, accessing a look up table that indicates algorithms and/or multipliers, associated with the respective bypass aerosol 272, bypass air 274, generated aerosol 220, remainder generated aerosol 290, drawn air 275, a sub-combination thereof, or a combination thereof, that correspond to the determined configurations of the one or more flow control devices 292, 294, 296, 298, and applying the determined flow rate of drawn aerosol 230 to the indicated algorithms and/or multipliers to determine the flow rates of bypass aerosol 272, bypass air 274, generated aerosol 220, remainder generated aerosol 290, drawn air 275, a sub-combination thereof, or a combination thereof. The look up table may be generated empirically via well-known techniques.

Based on the aforementioned determinations, the flow rate and amount of an instance of generated aerosol 220 that is included in a given instance of drawn aerosol 230 as an instance of remainder generated aerosol 290 may be determined in some example embodiments.

While the example embodiments shown in FIGS. 1A-1C include an assembly 300 wherein the sensor apparatus 100 is coupled to an external tobacco element 200 that may generate the generated aerosol 220, it will be understood that, in some example embodiments, the assembly 300 may include a sensor apparatus 100 that is coupled to an external element that is an electronic vaping device that is configured to generate the generated aerosol 220, instead of being coupled to an external tobacco element 200. In some example embodiments, the electronic vaping device may generate the generated aerosol 220 based on heating a pre-vapor formulation. In some example embodiments, the electronic vaping device may not include any tobacco. In some example embodiments, the electronic vaping device may generate the generated aerosol 220 based on applying mechanical force to a pre-vapor formulation. Accordingly, where example embodiments described herein may be described with reference to a generated aerosol 220 received from an external tobacco element 200 at a sensor apparatus 100, it will be understood that the generated aerosol 220, in some example embodiments, may be received from an external tobacco element 200 coupled to a sensor apparatus 100 or, in some example embodiments may be received from an electronic vaping device coupled to a sensor apparatus 100, from an electronic nicotine delivery system coupled to a sensor apparatus 100, or from any device that may generate an aerosol coupled to a sensor apparatus 100.

Figure 2:
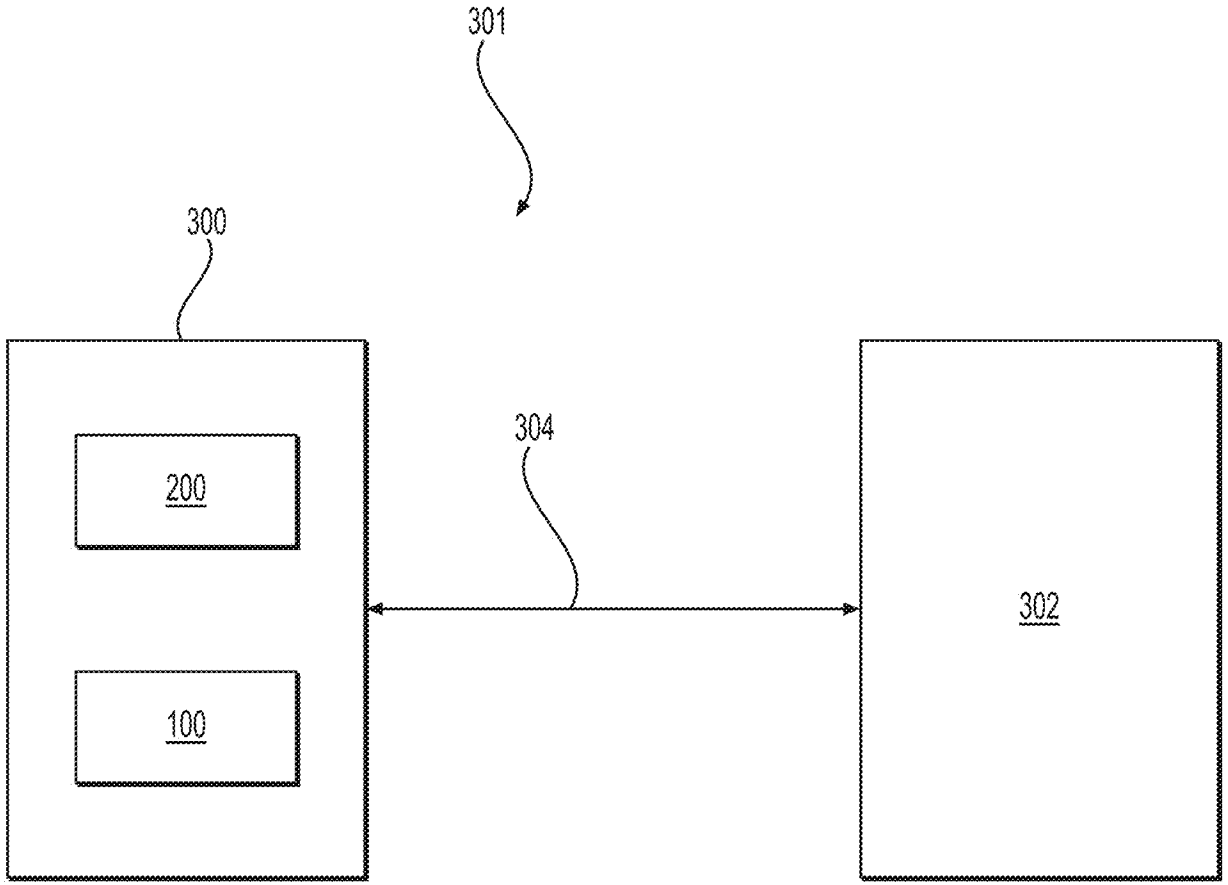
FIG. 2 is a schematic of a system configured to enable display and/or communication of topography information at one or more devices based on sensor data generated at a sensor apparatus according to some example embodiments.

FIG. 2 is a schematic of a system configured to enable display and/or communication of topography information at one or more devices based on sensor data generated at a sensor apparatus according to some example embodiments.

In some example embodiments, an assembly 300, including a sensor apparatus 100 and an external tobacco element 200 as shown in FIGS. 1A-1C, may be communicatively coupled to one or more external computing devices 302 of a system 301 configured to enable display and/or communication of topography information at one or more devices based on sensor data generated at the sensor apparatus 100, via one or more communication links 304.

In some example embodiments, a computing device 302 communicatively coupled to the assembly 300 may generate one or more feedback control signals based on generated topography information, including a determined aerosol draw pattern associated with one or more instances of an aerosol drawn through the sensor apparatus 100. In some example embodiments, the one or more feedback control signals may cause a sensor apparatus 100 to control a feedback device 199 thereof to generate one or more feedback signals based on a determination of whether one or more aerosol properties of an aerosol draw pattern exceeds a corresponding one or more threshold aerosol properties of a threshold aerosol draw pattern, thereby exceeding the threshold aerosol draw pattern. In some example embodiments, the one or more feedback control signals may cause a sensor apparatus 100 to control one or more flow control devices 292, 294, 296, 298 thereof to control an amount, flow rate, and/or proportion of remainder generated aerosol 290 that is included in one or more instances of drawn aerosol 230 that are drawn through the sensor apparatus 100, based on a determination of whether one or more aerosol properties of an aerosol draw pattern exceeds a corresponding one or more threshold aerosol properties of a threshold aerosol draw pattern.

In some example embodiments, an aerosol property of an aerosol draw pattern includes an indication of a time variation of a cumulative amount of remainder generated aerosol 290 included in one or more instances of drawn aerosol 230 drawn through a sensor apparatus 100 over a period of time, and the determination of whether the aerosol draw pattern exceeds a corresponding threshold aerosol draw pattern includes determining, at a given time, whether a cumulative amount of remainder generated aerosol 290 included in one or more instances of drawn aerosol 230 drawn through a sensor apparatus 100 during the period of time up to the given time exceeds a threshold cumulative amount of remainder generated aerosol 290, of the threshold aerosol draw pattern, that may be included in one or more instances of drawn aerosol 230 drawn through the sensor apparatus in the same period of time up to the same given time.

In some example embodiments, the threshold aerosol draw pattern may be expressed as an algorithmic expression of the threshold cumulative remainder generated aerosol 290 at any given time within a given period of time as a function of the given elapsed time from a start of the time period. Various known methods may be used. For example, the threshold cumulative remainder generated aerosol 290 may be expressed as a function $y=xa$, where x is the elapsed time, $x=0$ is the start of the time period, a is a constant value, and y is the threshold cumulative remainder generated aerosol 290. In another example, the threshold cumulative remainder generated aerosol 290 may be expressed as a function $y=ax^2+bx+c$, where x is the elapsed time, $x=0$ is the start of the time period, a, b, and c are constant values, and y is the threshold cumulative remainder generated aerosol 290. The threshold aerosol draw pattern may define a time-variation of threshold cumulative remainder generated aerosol 290 that may be drawn through sensor apparatus 100 over a particular period of time.

In some example embodiments, an aerosol draw pattern may be determined to exceed a corresponding threshold aerosol draw pattern based on a determination that an aerosol property of the aerosol draw pattern has a value that exceeds a value of a corresponding threshold aerosol property of a corresponding threshold aerosol draw pattern. For example, in response to a determination that a historical aerosol draw pattern indicates a cumulative amount of remainder generated aerosol 290 that has been drawn through sensor apparatus 100 over a particular period of time is greater than a value of a threshold cumulative amount, as indicated by a corresponding threshold aerosol draw pattern, of remainder generated aerosol 290 that may be drawn through sensor apparatus 100 over the same particular period of time, the historical aerosol draw pattern may be determined to have exceeded the corresponding threshold aerosol draw pattern. In another example, in response to a determination that the historical aerosol draw pattern indicates that the cumulative amount of remainder generated aerosol 290 that has been drawn through sensor apparatus 100 over the particular period of time is equal to or less than the value of a threshold cumulative amount, as indicated by the corresponding threshold aerosol draw pattern, of remainder generated aerosol 290 that may be drawn through sensor apparatus 100 over the same particular period of time, the historical aerosol draw pattern may be determined to have conformed to the corresponding threshold aerosol draw pattern.

In some example embodiments, a feedback control signal may be different based on whether an aerosol draw pattern, generated based on information generated at a sensor apparatus 100, is determined to exceed or conform to a corresponding threshold aerosol draw pattern. For example, the sensor apparatus 100 may be caused to control a feedback device 199 to generate different feedback signals based on whether the aerosol draw pattern exceeds or conforms to the corresponding threshold aerosol draw pattern. The different feedback signals may provide an externally-observable indication of whether one or more instances of aerosol draws through the sensor apparatus 100, as represented by an aerosol draw pattern, are conforming to a threshold aerosol draw pattern, thereby enabling an adult tobacco consumer (ATC) associated with the sensor apparatus 100 to monitor comparative performance of the aerosol draw pattern against the threshold aerosol draw pattern and potentially adjust one or more aerosol properties of the aerosol draw pattern to at least conform to the threshold aerosol draw pattern, thereby enabling improved control of operation of assembly 300.

In another example, the sensor apparatus 100 may be caused to control one or more flow control devices 292, 294, 296, 298 to implement different adjustments to flow of one or more instances of at least the remainder generated aerosol 290 through the sensor apparatus 100 based on whether the aerosol draw pattern exceeds or conforms to the corresponding threshold aerosol draw pattern. As a result, the sensor apparatus 100 may provide improved control over the drawing of generated aerosol 220 from an external tobacco element 200 and at least partially through sensor apparatus 100 in drawn aerosol 230, as remainder generated aerosol 290, and thus provide improved control of operation of assembly 300.

Figure 3A:
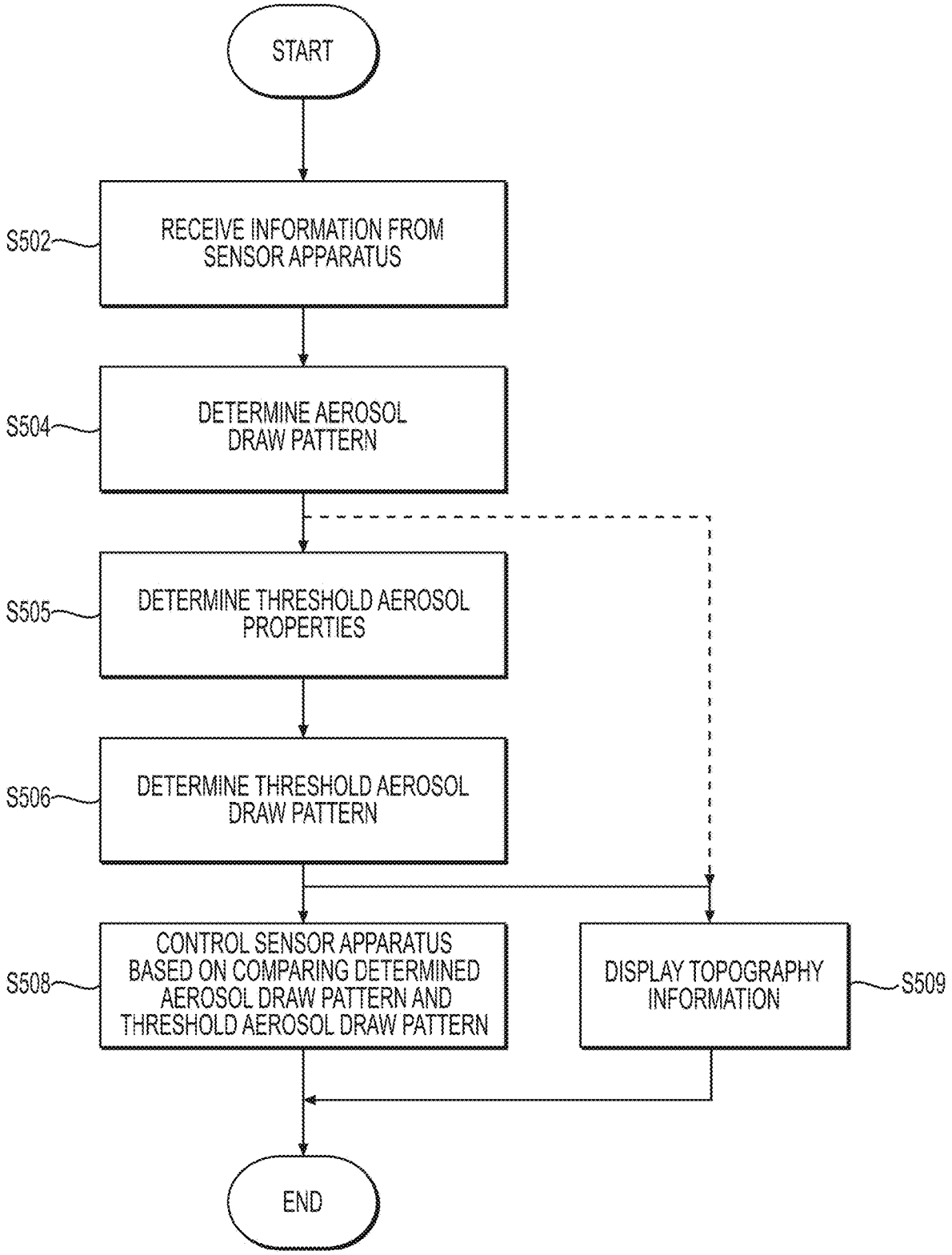
FIGS. 3A and 3B are flowcharts illustrating operations of a computing device to control a sensor apparatus via feedback control signals based on information received from a sensor apparatus according to some example embodiments.
Figure 3B:
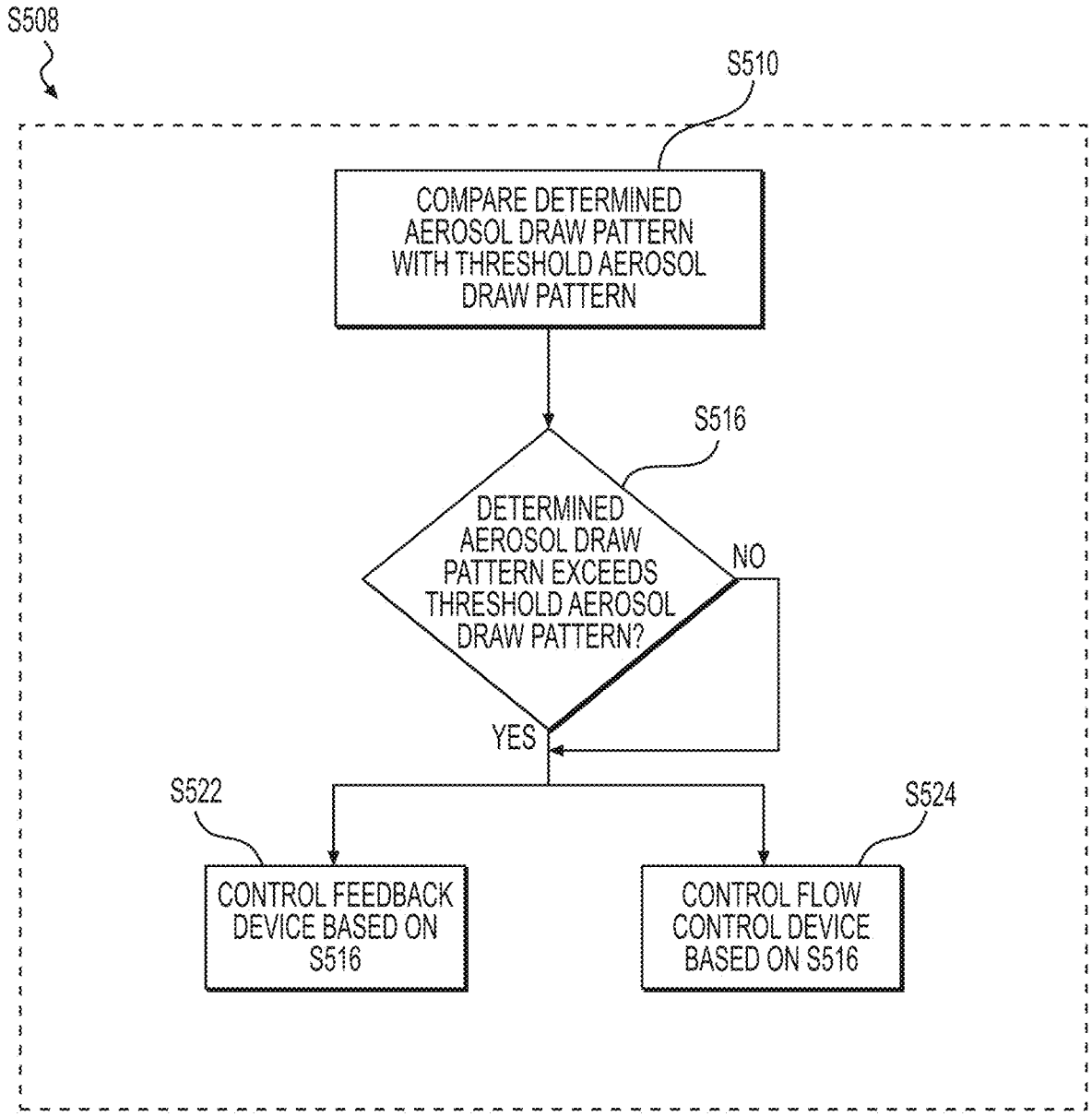

FIGS. 3A and 3B are flowcharts illustrating operations of a computing device to adjustably control a sensor apparatus via feedback control signals based on information received from a sensor apparatus according to some example embodiments. The operations illustrated in FIGS. 3A and 3B may be implemented, in whole or in part, by one or more portions of any embodiment of at least one device of computing device 302, sensor apparatus 100, or a combination thereof, as described herein. For example, the operations illustrated in FIGS. 3A and 3B may be implemented based on a processor included in the computing device 302 executing a program of instructions stored in a memory of the computing device 302. In another example, the operations illustrated in FIGS. 3A and 3B may be implemented based on a processor included in the sensor apparatus 100 executing a program of instructions stored in a memory of the sensor apparatus 100.

Referring first to FIG. 3A, at S502, one or more instances of information are received from a sensor apparatus 100, where the one or more instances of information include information associated with sensor data generated at the sensor apparatus 100. Such information may include information associated with one or more instances of aerosol that may be drawn through the sensor apparatus 100 over a period of time, and may include information associated with one or more complete instances of aerosol that were previously drawn through the sensor apparatus, information associated with a presently-ongoing instance of aerosol that is presently being drawn through the sensor apparatus 100, or a combination thereof. Such information may include, for example, information indicating separate pressures measured by separate pressure sensor devices 172A, 172B of the sensor apparatus 100.

At S504, the one or more instances of information are processed to generate and/or update an instance of topography information, where the topography information may include information indicating an aerosol draw pattern associated with one or more instances of aerosol previously drawn and/or presently being drawn through the sensor apparatus 100. For example, at S504, the one or more instances of information may be processed to generate an aerosol draw pattern that indicates historical time variation of one or more aerosol properties of one or more previous instances of an aerosol drawn through the sensor apparatus 100 during a particular period of time and a projection of future time variation of the one or more aerosol properties upon completion of a presently-ongoing instance of aerosol presently being drawn through the sensor apparatus 100, as indicated by information received from the sensor apparatus 100 at S502.

At S505, one or more threshold aerosol properties of a threshold aerosol draw pattern may be determined, selected, and/or received from an interface of the computing device 302. For example, a threshold aerosol property may include a specification of a threshold cumulative amount of remainder generated aerosol 290 included in the cumulative amount of drawn aerosol 230 that is drawn through the sensor apparatus 100 within a particular period of time and a threshold rate of time-variation of the threshold cumulative amount of remainder generated aerosol 290 included in the cumulative drawn aerosol 230 over the period of time.

At S506, a threshold aerosol draw pattern is determined, based at least in part upon the aerosol draw pattern that is determined at S504 and/or the threshold aerosol properties received, selected, and/or determined at S505. As described above, the threshold aerosol draw pattern may be expressed as an algorithmic expression of the threshold cumulative remainder generated aerosol 290 included in the cumulative drawn aerosol 230 at any given time within a given period of time as a function of the given elapsed time from a start of the time period.

At S508, the sensor apparatus 100 may be controlled, according to one or more feedback control signals, based on whether the aerosol draw pattern that is determined at S504 exceeds or conforms to the threshold aerosol draw pattern that is determined at S506. As described below with reference to FIG. 3B, such control may include controlling a feedback device 199 to generate one or more particular feedback signals and/or controlling one or more flow control devices 292, 294, 296, 298 to cause the time-variation of the cumulative amount of remainder generated aerosol 290 drawn through the sensor apparatus 100 during the time period to not exceed a time-varying threshold cumulative amount of remainder generated aerosol 290 as defined by the threshold aerosol draw pattern.

At S509, topography information may be displayed in a graphical display interface of computing device 302. The displayed topography information may include information indicating time-variation of one or more particular aerosol properties of the determined aerosol draw pattern, information indicating time variation of one or more threshold aerosol properties of the threshold aerosol draw pattern, information indicating one or more instances of aerosol drawn through the sensor apparatus 100 during a time period, a sub-combination thereof, or a combination thereof. As shown in FIG. 3A, the displaying at S509 may be performed concurrently with performing one or more of S505-S508.

In some example embodiments, operation S508 may be omitted and topography information may be displayed, at S509, without any control of any portion of the sensor apparatus 100 via one or more feedback control signals. In some example embodiments, operations S505 and S506 may be omitted in addition to operation S508 being omitted, and the topography information displayed at S509 may omit any display of information associated with any threshold aerosol draw pattern.

Referring now to FIG. 3B, operation S508 may include various operations S510 through S524.

At S510, one or more aerosol properties of the projected aerosol draw pattern is compared with a corresponding one or more threshold aerosol properties associated with the threshold aerosol draw pattern. For example, as described above with reference to S504, a projected aerosol draw pattern may be generated based on the historical aerosol draw pattern and information, received at S502, associated with a presently-ongoing instance of aerosol being drawn through the sensor apparatus 100, and a projected cumulative remainder generated aerosol 290 drawn during the current time period upon completion of the instance of aerosol may be compared with a corresponding threshold cumulative remainder generated aerosol 290 amount of the threshold aerosol draw pattern that associated with the same time period as the time period in which the presently ongoing instance of aerosol is projected to be completed.

At S516, a determination is made regarding whether the one or more aerosol properties of the determined aerosol draw pattern exceed or conform to the corresponding one or more threshold aerosol properties of the threshold aerosol draw pattern, such that the determined aerosol draw pattern is determined to exceed or conform to the threshold aerosol draw pattern.

Based on the determination at S516, as shown at S522, S524, or a combination thereof, one or more feedback control signals may be generated to control one or more aspects of the sensor apparatus 100. One or more of operations S522 and S524 may be omitted.

In one example, if the determined aerosol draw pattern conforms to the threshold aerosol draw pattern at S516, at S522 a feedback control signal may be generated to cause the feedback device 199 of the sensor apparatus 100 to generate an externally observable feedback signal to indicate that the aerosol draw pattern conforms to the threshold aerosol draw pattern. In another example, if the determined aerosol draw pattern conforms to the threshold aerosol draw pattern at S516, at S524 a feedback control signal may be generated to cause one or more flow control devices of the sensor apparatus 100 to enable an entirety of the generated aerosol 220 to be included in the drawn aerosol 230, for example without augmenting the drawn aerosol 230 with bypass air 274, during the remainder of the ongoing instance of drawn aerosol 230 and/or a subsequent instance of drawn aerosol 230.

In another example, if the determined aerosol draw pattern exceeds the threshold aerosol draw pattern at S516, at S522 a feedback control signal may be generated to cause the feedback device 199 of the sensor apparatus 100 to generate an externally observable feedback signal to indicate that the aerosol draw pattern exceeds the particular aerosol draw pattern. In addition, if the determined aerosol draw pattern exceeds the threshold aerosol draw pattern at S516, at S524 a feedback control signal may be generated to cause one or more flow control devices of the sensor apparatus 100 to adjustably control an amount and/or proportion of the remainder generated aerosol 290 to be included in the ongoing instance and/or subsequent instances of drawn aerosol 230 to be a limited portion of the generated aerosol 220, such that at least a portion of the generated aerosol 220 is directed to the ambient environment 310 independently of a remainder of the conduit 129 as bypass aerosol 272. In addition, bypass air 274 may be caused to be drawn into conduit 129 to mitigate flow rate variation between the flow rates of drawn aerosol 230 and generated aerosol 220.

Accordingly, at S524, the sensor apparatus 100 may be configured to adjustably control one or more flow control devices 292, 294, 296, 298 to cause one or more aspects of the flow of a drawn aerosol 230, in one or more instances of drawn aerosol 230, to conform to the threshold aerosol draw pattern, for example based on controlling the proportion and/or amount of remainder generated aerosol 290 included in one or more instances of drawn aerosol 230 to cause a cumulative amount of remainder generated aerosol 290 included in the cumulative drawn aerosol 230 over a period of time to not exceed a threshold cumulative amount of remainder generated aerosol 290 that is defined by the particular aerosol draw pattern.

At S524, the one or more flow control devices 292, 294, 296, 298 of the sensor apparatus 100 may be controlled to control the amount and/or proportion of generated aerosol 220 included in the drawn aerosol 230 as remainder generated aerosol 290 without substantial variation in the flow rate of drawn aerosol 230. Substantial variation in the flow rate of the drawn aerosol 230 may include a variation of more than 10% of the flow rate of the drawn aerosol 230 from a base flow rate of the drawn aerosol that corresponds to none of the generated aerosol 220 being directed away from the outlet 148 as bypass aerosol 272. Such control may first include determining a target flow rate of the drawn aerosol 230. The target flow rate may be determined to be identical to a determined initial flow rate of an ongoing instance of drawn aerosol 230, a determined flow rate associated with instances of drawn aerosol associated with the present point in time during the present period of time, as defined by the historical aerosol draw pattern, a sub-combination thereof, or a combination thereof. Additionally, the control may include determining a target amount, proportion, and/or flow rate of remainder generated aerosol 290 in the target flow rate of drawn aerosol 230. Such determination may be based on determining a maximum amount, proportion, and/or flow rate of remainder generated aerosol 290 included in the current instance and/or subsequent instance of drawn aerosol 230 that causes the cumulative amount of generated aerosol 220 included in the cumulative drawn aerosol 230 during the given time period to not exceed the threshold cumulative generated aerosol at the given time as defined by the threshold aerosol draw pattern.

The control may further include determining a configuration of one or more flow control devices 292, 294, and 296 included in the sensor apparatus 100 that are associated with the determined target flow rate of drawn aerosol 230 and determined maximum amount, proportion, and/or flow rate of remainder generated aerosol 290 included in the current, ongoing instance and/or subsequent instance of drawn aerosol 230. Such a determining may include accessing a look up table that correlates various values of drawn aerosol 230 flow rate and amount, proportion, and/or flow rate of remainder generated aerosol 290 with a corresponding set of configurations of one or more flow control devices 292, 294, 296, 298 of the sensor apparatus 100. Based on the determined configuration of the flow control device(s) of the sensor apparatus 100, a set of feedback control signals that cause the sensor apparatus 100 to control the one or more flow control devices thereof to achieve the determined configuration may be generated and may be transmitted to the sensor apparatus 100 to implement said determined configuration. The look up table may be generated empirically via well-known techniques.

Figure 4A:
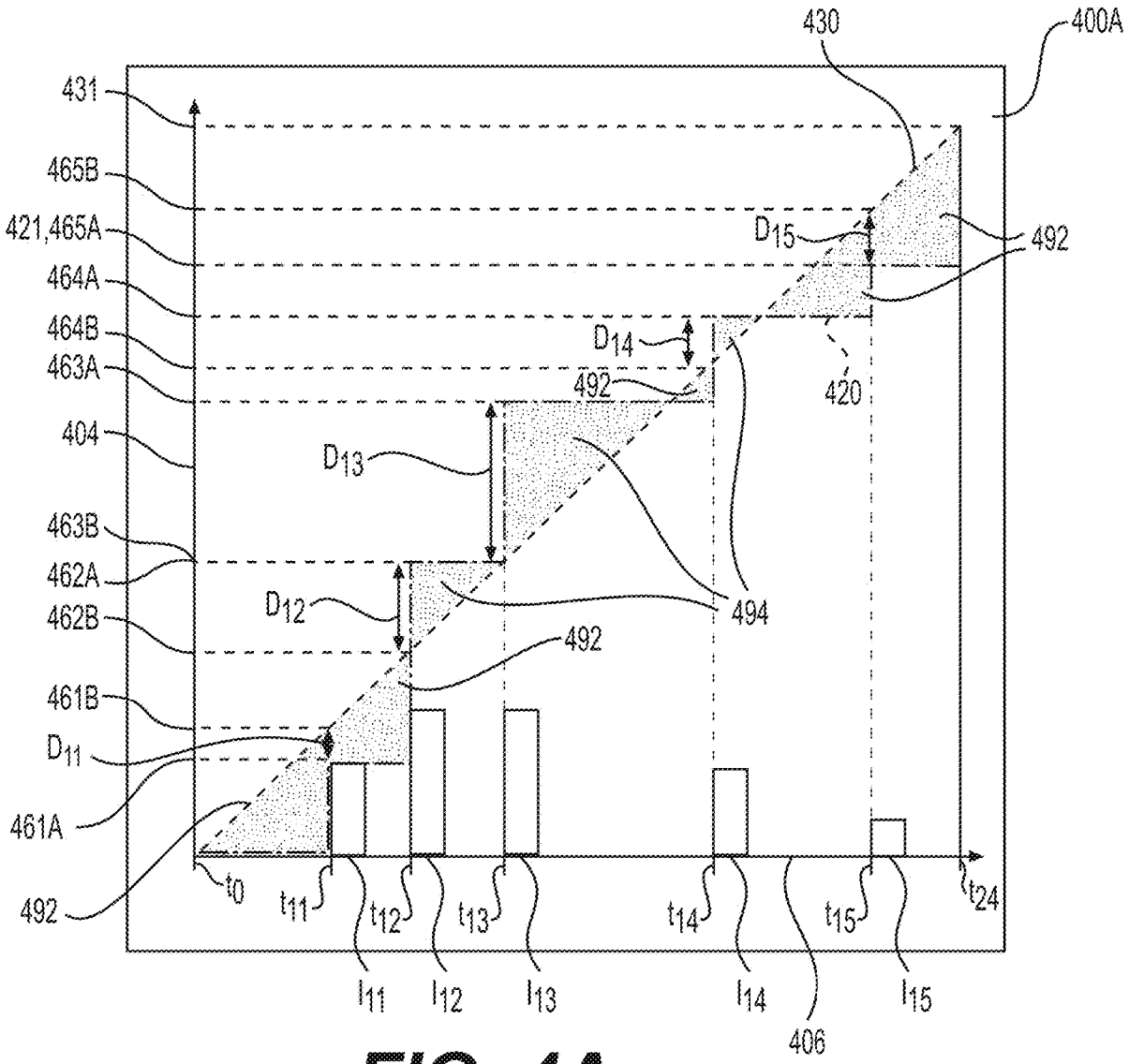
FIGS. 4A and 4B illustrate graphical representations of topography information based on processing information generated at a sensor apparatus according to some example embodiments.
Figure 4B:
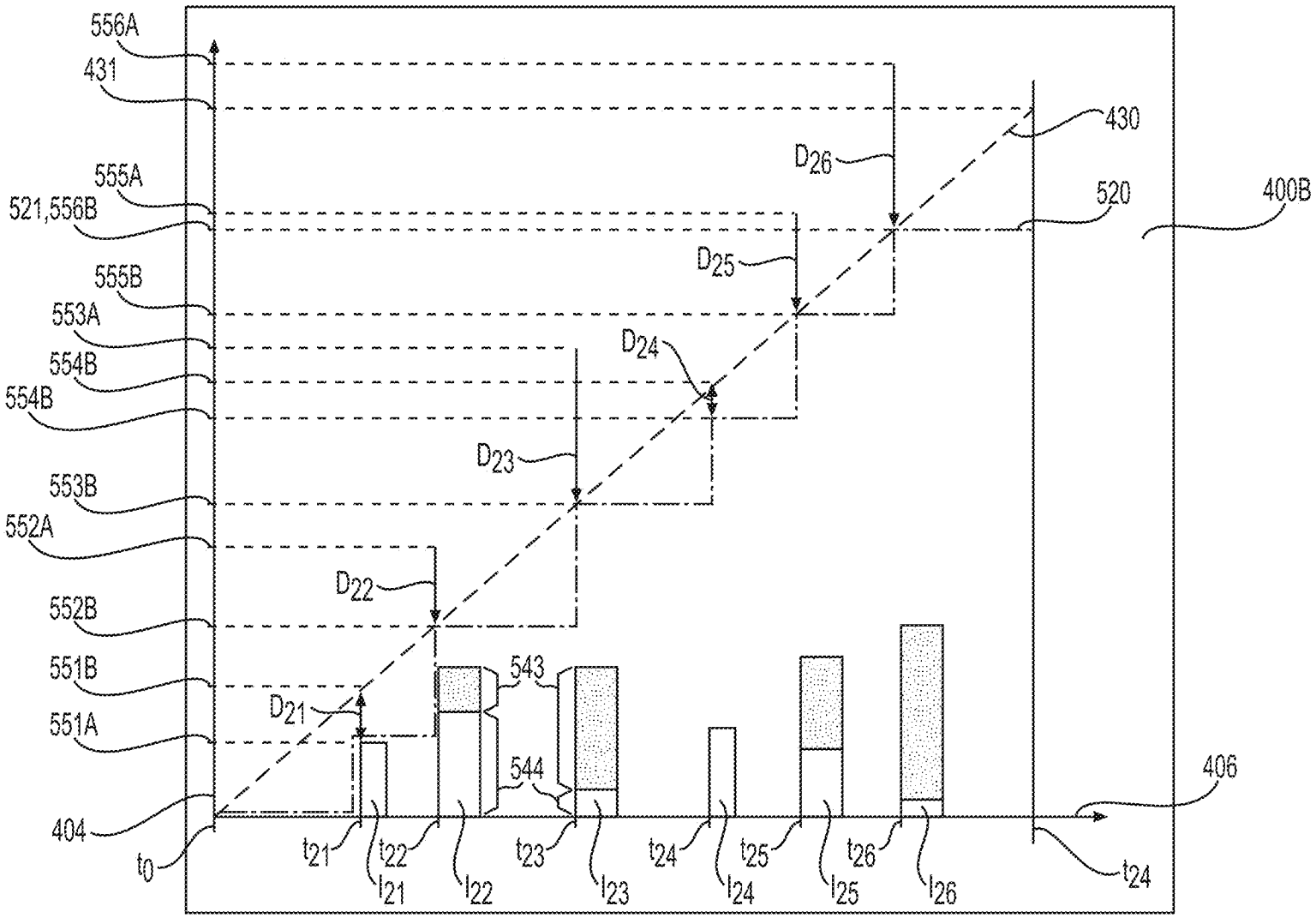

FIGS. 4A and 4B illustrate graphical representations of topography information generated based on processing information generated at a sensor apparatus according to some example embodiments.

The graphical representations (also referred to herein as displays and/or displayed instances of topography information) illustrated in FIGS. 4A and 4B may be generated and/or updated, in whole or in part, by one or more portions of any embodiment of one or more computing devices 302 and/or sensor apparatuses 100 as described herein. For example, the graphical representations illustrated in FIGS. 4A and 4B may be generated by a processor included in the computing device 302 executing a program of instructions stored in a memory of the computing device 302. In another example, the graphical representations illustrated in FIGS. 4A and 4B may be generated by a processor included in the control circuitry 171 of the sensor apparatus 100 executing a program of instructions stored in a memory of the control circuitry 171.

Referring now to FIG. 4A, a graphical representation 400A of an aerosol draw pattern 420 of one or more instances of aerosol drawn through a sensor apparatus 100 over a period of time $t_0$-$t_{24}$ may be generated based on topography information, where the topography information is generated based on sensor data generated by pressure sensor devices 172A, 172B of the sensor apparatus 100 over the period of time $t_0$-$t_{24}$. Graphical representation 400A may be a two-dimensional chart, where axis 404 represents the cumulative amount of an aerosol included in one or more instances of an aerosol drawn through the sensor apparatus 100 during a period of time $t_0$-$t_{24}$ as shown in FIG. 4A, and where axis 406 represents time/duration.

Still referring to FIG. 4A, graphical representation 400A may include an aerosol draw pattern 420 which illustrates a time variation of the cumulative amount of an aerosol included in one or more instances $I_{11}$ to $I_{1N}$ of an aerosol drawn through the sensor apparatus 100 during the given time period $t_0$-$t_{24}$ as shown in FIG. 4A (N being a positive integer). The aerosol draw pattern 420, which illustrates the time variation of the cumulative amount of an aerosol from a null value at the start $t_0$ of the time period $t_0$-$t_{24}$ to a total cumulative amount 421 at the end $t_{24}$ of the time period $t_0$-$t_{24}$ may be generated based on the aforementioned topography information.

Still referring to FIG. 4A, graphical representation 400A may further include representations of the amount of aerosol included in each instance $I_1$ to $I_N$ of aerosol that is drawn through the sensor apparatus 100 during the time period $t_0$-$t_{24}$. As shown, each representation of an instance $I_1$ to $I_N$ in representation 400A has a y-axis dimension that is proportional to a flow rate of the given instance $I_1$ to $I_N$ of aerosol and an x-axis dimension that is proportional to a duration of the given instance $I_1$ to $I_N$ of aerosol. Accordingly, in some example embodiments, the area of the representation of the given instance $I_1$ to $I_N$ is proportional to the total amount of aerosol included in the given instance $I_1$ to $I_N$ of aerosol that is drawn through the sensor apparatus 100.

As shown in FIG. 4A, the time-variation of the cumulative amount of aerosol as shown in the aerosol draw pattern 420 is based on the time of each instance $I_1$ to $I_N$ during the time period and the amount aerosol included in each instance as indicated by the representations $I_1$ to $I_N$.

Graphical representation 400A may be updated over time to include new representations of instances $I_1$ to $I_N$ of aerosol drawn through the sensor apparatus 100 and/or to update the aerosol draw pattern 420 based on information received from the sensor apparatus 100 over time during one or more time periods.

In some example embodiments, the one or more instances of aerosol as indicated in the graphical representation 400A may be one or more instances of the drawn aerosol 230, and the cumulative amount of an aerosol included in one or more instances of an aerosol drawn through the sensor apparatus 100 may be a cumulative amount of the drawn aerosol 230 included in the one or more instances of drawn aerosol 230 that are drawn through the sensor apparatus 100. It will be understood that the aerosol as indicated in the graphical representation may be different from the drawn aerosol 230. For example, the one or more instances of aerosol as indicated in the graphical representation 400A may be one or more instances of the remainder generated aerosol 290, and the cumulative amount of an aerosol included in one or more instances of an aerosol drawn through the sensor apparatus 100 may be a cumulative amount of the remainder generated aerosol 290 that is drawn through the sensor apparatus 100.

It will be understood, in some example embodiments, that the aerosol for which a time-variation of cumulative amount is shown by the aerosol draw pattern 420 may be different than the aerosol for which the one or more instances are shown. For example, in some example embodiments, the aerosol draw pattern 420 indicated in the graphical representation 400A may indicate a time-variation of the cumulative amount of remainder generated aerosol 290 that is included in one or more instances of drawn aerosol 230 that are drawn through the sensor apparatus 100 over a period of time $t_0$-$t_{24}$.

Still referring to FIG. 4A, the graphical representation 400A may include a simultaneously display of an aerosol draw pattern 420 and a threshold aerosol draw pattern 430. Accordingly, the variation in the aerosol draw pattern 420 in relation to the threshold aerosol draw pattern 430 may be more readily observed and understood.

As shown in FIG. 4A, the threshold aerosol draw pattern 430 may be represented by an algorithm, including a linear algorithm as shown, where the threshold aerosol draw pattern 430 is associated with a threshold aerosol property that is a total threshold cumulative amount 431, for a given time period, which may be set to be less than the total cumulative amount 421 of the aerosol draw pattern 420. The threshold aerosol draw pattern 430 may be determined such that the total threshold cumulative amount 431 resulting from the threshold aerosol draw pattern 430, for a given time period, is less than the total cumulative amount 421, for a given time period, by at least a threshold amount and/or proportion. In an example, threshold aerosol draw pattern 430 may be a linear algorithm where the value of the total threshold cumulative amount 431 is at least 10% less than total cumulative amount 421. In some example embodiments, the threshold aerosol draw pattern 430 may be repeatedly adjusted over time, such that the total threshold cumulative amount 431 in a given time period is revised to be less than the total cumulative amount 421 for a previous time period. Accordingly, the total cumulative amount of aerosol drawn through the sensor apparatus 100 may be progressively reduced over time.

As described herein with regard to FIGS. 4A-4B and as described herein with reference to FIGS. 3A-3B, one or more feedback control signals may be generated based on whether the aerosol draw pattern 420 conforms to the threshold aerosol draw pattern 430 or exceeds the threshold aerosol draw pattern 430 at a given time. Accordingly, based on generating one or more feedback control signals based on the threshold aerosol draw pattern 430, one or more instances of aerosol drawn through the sensor apparatus 100 in a given time period may be controlled in relation to a historical aerosol draw pattern as indicated by the topography information.

Still referring to FIG. 4A, graphical representation 400A illustrates an aerosol draw pattern 420, which indicates the time-variation of the cumulative amount of an aerosol drawn through the sensor apparatus 100 over a time period, being compared against a threshold aerosol draw pattern 430, which indicates the time-variation of the threshold cumulative amount of the aerosol drawn through the sensor apparatus 100 over the same time period, to trigger the generation of feedback control signals to provide an indication, at various times during the time period of whether the aerosol draw pattern 420 is exceeding or conforming to the threshold aerosol draw pattern 430. Such an indication may be provided via one or more feedback signals generated by a feedback device 199 of a sensor apparatus 100. Such an indication may be provided via an indication provided on a display interface of a computing device 302, a display device of the sensor apparatus 100, some combination thereof, or the like.

As shown at FIG. 4A, the cumulative amounts of aerosol of both the aerosol draw pattern 420 and the threshold aerosol draw pattern 430 are set to a null value at the start $t_0$ of the time period. The threshold cumulative amount of aerosol of the threshold aerosol draw pattern 430 may increase over time during the time period from to $t_0$-$t_{24}$ according to a linear algorithm that defines the threshold aerosol draw pattern 430, while the cumulative amount of aerosol of the aerosol draw pattern 420 \ increases in accordance with the amount of aerosol that is determined, based on sensor data generated by pressure sensor devices 172A, 172B, to be actually drawn through the sensor apparatus 100 in accordance with instances $t_{21}$ to $I_{25}$ of aerosol within a given time period $t_0$ to $t_{24}$ and at the respective times that the instances occur.

In some example embodiments, a feedback device 199 may be adjustably controlled, based on a determination, at the detection of each instance $I_{21}$ to $I_{25}$ of drawn aerosol 230, of whether an actual and/or projected cumulative amount of aerosol drawn through the sensor apparatus 100 is greater than the corresponding threshold cumulative amount of aerosol as indicated by the threshold aerosol draw pattern 430.

At time $t_{11}$, where instance $I_{11}$ of aerosol is detected based on processing sensor data generated by pressure sensor devices 172A, 172B and an initial flow rate of the instance $I_{11}$ of the aerosol is determined, the projected cumulative amount 461A of the aerosol that will be drawn through the sensor apparatus 100 upon completion of the presently ongoing instance $I_{11}$ of the aerosol may be determined to be less than the corresponding threshold cumulative amount 461B at time $t_{11}$ by difference $D_{11}$. In response to such a determination, one or more feedback control signals may be generated to cause the feedback device 199 of the sensor apparatus 100 to generate a first externally-observable feedback signal. In some example embodiments, the first externally-observable feedback signal may include a green light, a vibration at a first frequency, an audio signal at a first frequency and/or volume, a sub-combination thereof, or a combination thereof. In some example embodiments, as shown in FIG. 4A, the difference between the aerosol draw pattern 420 and the threshold aerosol draw pattern 430 may be highlighted with a first highlighting 492 to provide a visual indication of the low difference between the aerosol draw pattern 420 and the threshold aerosol draw pattern 430.

At time $t_{12}$, where instance $I_{12}$ of aerosol is detected based on processing sensor data generated by pressure sensor devices 172A, 172B and an initial flow rate of the instance $I_{12}$ of aerosol is determined, the projected cumulative amount 462A of the aerosol that will be drawn through the sensor apparatus 100 upon completion of the presently ongoing instance $I_{12}$ of the aerosol may be determined to be greater than the corresponding threshold cumulative amount 462B at time $t_{12}$ by difference $D_{12}$. In response to such a determination, one or more feedback control signals may be generated to cause the feedback device 199 of the sensor apparatus 100 to generate a second externally-observable feedback signal. In some example embodiments, the second externally-observable feedback signal may include a red light (the light could also be blue, green, yellow or any other color, sub-combinations or combinations thereof), a vibration at a second frequency, an audio signal at a second frequency and/or volume, a sub-combination thereof, or a combination thereof. In some example embodiments, as shown in FIG. 4A, the difference between the aerosol draw pattern 420 and the threshold aerosol draw pattern 430 may be highlighted with a second highlighting 494 to provide a visual indication of the high difference between the aerosol draw pattern 420 and the threshold aerosol draw pattern 430.

At time $t_{13}$, where instance $I_{13}$ of aerosol is detected based on processing sensor data generated by pressure sensor devices 172A, 172B and an initial flow rate of the instance $I_{13}$ of aerosol is determined, the projected cumulative amount 463A of the aerosol that will be drawn through the sensor apparatus 100 upon completion of the presently ongoing instance $I_{13}$ of the aerosol may be determined to be greater than the corresponding threshold cumulative amount 463B at time $t_{13}$ by difference $D_{13}$. In response to such a determination, one or more feedback control signals may be generated to cause the feedback device 199 of the sensor apparatus 100 to generate the second externally-observable feedback signal. In some example embodiments, as shown in FIG. 4A, the difference between the aerosol draw pattern 420 and the threshold aerosol draw pattern 430 may be highlighted with a second highlighting 494 to provide a visual indication of the high difference between the aerosol draw pattern 420 and the threshold aerosol draw pattern 430.

At time $t_{14}$, where instance $I_{14}$ of aerosol is detected based on processing sensor data generated by pressure sensor devices 172A, 172B and an initial flow rate of the instance $I_{14}$ of the aerosol is determined, the projected cumulative amount 464A of the aerosol that will be drawn through the sensor apparatus 100 upon completion of the presently ongoing instance $I_{14}$ of the aerosol may be determined to be greater than the corresponding threshold cumulative amount 464B at time $t_{14}$ by difference $D_{14}$. In response to such a determination, one or more feedback control signals may be generated to cause the feedback device 199 of the sensor apparatus 100 to generate the second externally-observable feedback signal. In some example embodiments, as shown in FIG. 4A, the difference between the aerosol draw pattern 420 and the threshold aerosol draw pattern 430 may be highlighted with a second highlighting 494 to provide a visual indication of the high difference between the aerosol draw pattern 420 and the threshold aerosol draw pattern 430.

At time $t_{15}$, where instance $I_{15}$ of aerosol is detected based on processing sensor data generated by pressure sensor devices 172A, 172B and an initial flow rate of the instance $I_{15}$ of the aerosol is determined, the projected cumulative amount 465A of the aerosol that will be drawn through the sensor apparatus 100 upon completion of the presently ongoing instance $I_{15}$ of the aerosol may be determined to be less than the corresponding threshold cumulative amount 465B at time $t_{15}$ by difference $D_{15}$. In response to such a determination, one or more feedback control signals may be generated to cause the feedback device 199 of the sensor apparatus 100 to generate the first externally-observable feedback signal. In some example embodiments, as shown in FIG. 4A, the difference between the aerosol draw pattern 420 and the threshold aerosol draw pattern 430 may be highlighted with the first highlighting 492 to provide a visual indication of the low difference between the aerosol draw pattern 420 and the threshold aerosol draw pattern 430.

As further shown in FIG. 4A, because instance $I_{15}$ of the aerosol is the final instance of aerosol drawn through the sensor apparatus 100 during time period $t_0$ to $t_{24}$, the cumulative amount 465A is equal to the total cumulative amount 421 that is drawn through the sensor apparatus 100 during the time period $t_0$ to $t_{24}$. As further shown, based on the control of the feedback control signals generated to control a feedback device 199 and/or a displayed graphical representation 400A, the total cumulative amount of the aerosol may be controlled by an ATC in response to the feedback control signals to be a total cumulative amount 421 that is less than the total threshold cumulative amount 431 for the same time period.

While the above description of FIG. 4A describes the generation of feedback control signals in response to determinations of whether projected cumulative amounts of an aerosol to be drawn through a sensor apparatus 100 will exceed a corresponding threshold cumulative amount of the aerosol as indicated by the threshold aerosol draw pattern, it will be understood that, in some example embodiments, the generation of feedback control signals is in response to determined actual cumulative amounts of aerosol that have already been drawn through the sensor apparatus 100, such that feedback control signals are generated based on historical amounts of aerosol that are drawn through the sensor apparatus 100 instead of projected amounts of aerosol that will be drawn through the sensor apparatus 100.

Referring now to FIG. 4B, graphical representation 400B illustrates the flow of an aerosol through the sensor apparatus 100 being controlled, via one or more feedback control signals generated according to at least the threshold aerosol draw pattern 430, to cause the aerosol draw pattern 520 to conform to the threshold aerosol draw pattern 430, such that the time-varying cumulative amount of an aerosol that is drawn through the sensor apparatus 100, as indicated by the aerosol draw pattern 520 during a given time period $t_0$ to $t_{24}$ as shown in FIG. 4B does not exceed the corresponding time-varying threshold cumulative amount of the aerosol as indicated by the threshold aerosol draw pattern 430 during the same given time period.

In some example embodiments, including the example embodiments shown in FIG. 4B, the aerosol draw pattern 520 indicates the time-variation of the cumulative amount of remainder generated aerosol 290 that is included in one or more instances $I_{21}$ to $I_{26}$ of drawn aerosol 230 that are drawn through the sensor apparatus 100, but example embodiments are not limited thereto. As shown in FIG. 4B, graphical representation 400B illustrates the effect of controlling the sensor apparatus 100 to control the amount and/or proportion of remainder generated aerosol 290 included in each separate instance $I_{21}$ to $I_{26}$ of drawn aerosol 230 that is drawn through the sensor apparatus 100 within a given time period $t_0$ to $t_{24}$.

Still referring to FIG. 4B, the cumulative amounts of remainder generated aerosol 290 of both the aerosol draw pattern 520 and the threshold aerosol draw pattern 430 are set to a null value at the start of the time period $t_0$. The threshold cumulative remainder generated aerosol 290 of the threshold aerosol draw pattern 430 increases over time during the time period from $t_0$ to $t_{24}$ according to a linear algorithm that defines the threshold aerosol draw pattern 430, while cumulative remainder generated aerosol 290 of the aerosol draw pattern 520 increases in accordance with the amount of remainder generated aerosol 290 drawn through the sensor apparatus 100 in accordance with each successive instance $I_{21}$ to $I_{26}$ of drawn aerosol 230 that is drawn through the sensor apparatus 100 within a given time period $t_0$ to $t_{24}$ and at the respective times that the instances occur.

At time $t_{21}$, where instance $I_{21}$ of drawn aerosol 230 is detected based on processing sensor data generated by pressure sensor devices 172A, 172B and an initial flow rate of the instance $I_{21}$ of drawn aerosol 230, and a determined initial remainder generated aerosol 290 flow rate in the instance $I_{21}$ of drawn aerosol 230 is further determined based on the initial flow rate of the drawn aerosol 230 and a determined configuration of the one or more flow control devices 292, 294, 296, 298 of the sensor apparatus 100, a projected cumulative remainder generated aerosol 290 amount 551A that is projected to be drawn through the sensor apparatus 100 upon completion of the of the instance $I_{21}$ may be determined. As shown in FIG. 4B, the projected cumulative remainder generated aerosol 290 amount 551A may be determined to be less than the corresponding threshold cumulative amount 551B at time $t_{21}$ by difference $D_{21}$. Accordingly, the configuration of flow control device(s) of sensor apparatus 100 may not be adjusted in response to detection of instance $I_{21}$, such that the projected cumulative remainder generated aerosol 290 amount 551A is permitted to be drawn through sensor apparatus 100. Additionally, as shown in FIG. 4B with regard to instance $I_{21}$, the representation of instance $I_{11}$ may be uniformly highlighted with a first highlighting, so as to illustrate that instance $I_{21}$ of drawn aerosol 230 comprises an instance of remainder generated aerosol 290 that is an entirety of the instances of generated aerosol 220 that is drawn through the sensor apparatus 100.

At time $t_{22}$, where instance $I_{22}$ of drawn aerosol 230 is detected based on processing sensor data generated by pressure sensor devices 172A, 172B and an initial flow rate of the instance $I_{22}$ of drawn aerosol 230, and a determined initial remainder generated aerosol 290 flow rate in the instance $I_{22}$ of drawn aerosol 230 is further determined based on the initial flow rate of the drawn aerosol 230 and a determined configuration of the one or more flow control devices 292, 294, 296, 298 of the sensor apparatus 100, a projected cumulative remainder generated aerosol 290 amount 552A that is projected to be drawn through the sensor apparatus 100 upon completion of the of the instance $I_{22}$ may be determined. As shown in FIG. 4B, the projected cumulative remainder generated aerosol 290 amount 552A may be determined to be greater than the corresponding threshold cumulative amount 552B at time $t_{22}$ by difference $D_{22}$. Accordingly, the sensor apparatus 100 may be controlled, via one or more feedback control signals, to control one or more flow control devices 292, 294, 296, 298 thereof to adjust the projected amount of remainder generated aerosol 290 in the instance $I_{22}$ to not exceed the corresponding threshold cumulative amount 552B. Such control may cause instance $I_{22}$ of drawn aerosol 230 to only comprise an instance of remainder generated aerosol 290 that may be a limited portion of the instances of generated aerosol 220 drawn through the sensor apparatus 100 during the ongoing instance of drawn aerosol 230. Additionally, as shown in FIG. 4B with regard to instance $I_{22}$, the representation of instance $I_{22}$ may include separate portions 543, 544 having separate, first and second highlightings, where the first portion 544 is highlighted according to the first highlighting and the second portion 543 is highlighted according to the second highlighting, and where the first portion 544 has an area that is a proportion, of the total area of portions 543 and 544 of the given instance, that corresponds to a proportion of the remainder generated aerosol 290 in relation to the entirety of generated aerosol 220. Thus, the differently-highlighted portion 544 provides a representation of the portion of generated aerosol 220 of instance $I_{22}$ which is restricted from being included in the drawn aerosol 230 of the given instance $I_{22}$ based on being directed from the sensor apparatus 100 as bypass aerosol 272, thereby providing an illustration of the particular feedback control implemented on the sensor apparatus 100 in accordance with the threshold aerosol draw pattern 430 for each particular instance of drawn aerosol 230. Accordingly, the graphical representation 400B may provide an improved indication of the operation of the sensor apparatus 100 based on topography information generated based on sensor data generated at the sensor apparatus in order to provide improved control over the drawing of generated aerosol 220 through the sensor apparatus 100 to outlet opening 148 as at least a portion of drawn aerosol 230.

At time $t_{23}$, where instance $I_{23}$ of drawn aerosol 230 is detected based on processing sensor data generated by pressure sensor devices 172A, 172B and an initial flow rate of the instance $I_{23}$ of drawn aerosol 230, and a determined initial remainder generated aerosol 290 flow rate in the instance $I_{23}$ of drawn aerosol 230 is further determined based on the initial flow rate of the drawn aerosol 230 and a determined configuration of the one or more flow control devices 292, 294, 296, 298 of the sensor apparatus 100, a projected cumulative remainder generated aerosol 290 amount 553A that is projected to be drawn through the sensor apparatus 100 upon completion of the of the instance $I_{23}$ may be determined. As shown in FIG. 4B, the projected cumulative remainder generated aerosol 290 amount 552A may be determined to be greater than the corresponding threshold cumulative amount 553B at time $t_{23}$ by difference $D_{23}$. Accordingly, the sensor apparatus 100 may be controlled, via one or more feedback control signals, to control one or more flow control devices 292, 294, 296, 298 thereof to adjust the projected amount of remainder generated aerosol 290 in the instance $I_{23}$ to not exceed the corresponding threshold cumulative amount 553B. Such control may cause instance $I_{23}$ of drawn aerosol 230 to only comprise an instance of remainder generated aerosol 290 that may be a limited portion of the instance of generated aerosol 220 drawn through the sensor apparatus 100 during the ongoing instance of drawn aerosol 230, and the representation of instance $I_{23}$ may include separate portions 543, 544 having separate, first and second highlightings.

At time $t_{24}$, where instance $I_{14}$ of drawn aerosol 230 is detected based on processing sensor data generated by pressure sensor devices 172A, 172B and an initial flow rate of the instance $I_{24}$ of drawn aerosol 230, and a determined initial remainder generated aerosol 290 flow rate in the instance $I_{24}$ of drawn aerosol 230 is further determined based on the initial flow rate of the drawn aerosol 230 and a determined configuration of the one or more flow control devices 292, 294, 296, 298 of the sensor apparatus 100, a projected cumulative remainder generated aerosol 290 amount 554A that is projected to be drawn through the sensor apparatus 100 upon completion of the of the instance $I_{23}$ may be determined. As shown in FIG. 4B, the projected cumulative remainder generated aerosol 290 amount 554A may be determined to be less than the corresponding threshold cumulative amount 554B at time $t_{24}$ by difference $D_{24}$. Accordingly, the configuration of flow control devices 292, 294, 296, 298 of sensor apparatus 100 are not adjusted in response to detection of instance $I_{24}$, such that the projected cumulative remainder generated aerosol 290 amount 554A is permitted to be drawn through sensor apparatus 100. Additionally, as shown in FIG. 4B with regard to instance $I_{24}$, the representation of instance $I_{24}$ may be uniformly highlighted with a first highlighting, so as to illustrate that instance $I_{24}$ of drawn aerosol 230 comprises an instance of remainder generated aerosol 290 that is an entirety of the instance of generated aerosol 220 drawn through the sensor apparatus 100 during the ongoing instance of drawn aerosol 230.

At time $t_{25}$, where instance $I_{25}$ of drawn aerosol 230 is detected based on processing sensor data generated by pressure sensor devices 172A, 172B and an initial flow rate of the instance $I_{25}$ of drawn aerosol 230, and a determined initial remainder generated aerosol 290 flow rate in the instance $I_{25}$ of drawn aerosol 230 is further determined based on the initial flow rate of the drawn aerosol 230 and a determined configuration of the one or more flow control devices 292, 294, 296, 298 of the sensor apparatus 100, a projected cumulative remainder generated aerosol 290 amount 555A that is projected to be drawn through the sensor apparatus 100 upon completion of the of the instance $I_{25}$ may be determined. As shown in FIG. 4B, the projected cumulative remainder generated aerosol 290 amount 555A may be determined to be greater than the corresponding threshold cumulative amount 555B at time $t_{25}$ by difference $D_{25}$. Accordingly, the sensor apparatus 100 may be controlled, via one or more feedback control signals, to control one or more flow control devices 292, 294, 296, 298 thereof to adjust the projected amount of remainder generated aerosol 290 in the instance $I_{25}$ to not exceed the corresponding threshold cumulative amount 555B. Such control may cause instance $I_{25}$ of drawn aerosol 230 to only comprise an instance of remainder generated aerosol 290 that may be a limited portion of the instance of generated aerosol 220 drawn through the sensor apparatus 100 during the ongoing instance of drawn aerosol 230, and the representation of instance $I_{25}$ may include separate portions 543, 544 having separate, first and second highlightings.

At time $t_{26}$, where instance $I_{26}$ of drawn aerosol 230 is detected based on processing sensor data generated by pressure sensor devices 172A, 172B and an initial flow rate of the instance $I_{26}$ of drawn aerosol 230, and a determined initial remainder generated aerosol 290 flow rate in the instance $I_{26}$ of drawn aerosol 230 is further determined based on the initial flow rate of the drawn aerosol 230 and a determined configuration of the one or more flow control devices 292, 294, 296, 298 of the sensor apparatus 100, a projected cumulative remainder generated aerosol 290 amount 556A that is projected to be drawn through the sensor apparatus 100 upon completion of the of the instance $I_{26}$ may be determined. As shown in FIG. 4B, the projected cumulative remainder generated aerosol 290 amount 555A may be determined to be greater than the corresponding threshold cumulative amount 556B at time $t_{26}$ by difference $D_{26}$. Accordingly, the sensor apparatus 100 may be controlled, via one or more feedback control signals, to control one or more flow control devices 292, 294, 296, 298 thereof to adjust the projected amount of remainder generated aerosol 290 in the instance $I_{26}$ to not exceed the corresponding threshold cumulative amount 556B. Such control may cause instance $I_{26}$ of drawn aerosol 230 to only comprise an instance of remainder generated aerosol 290 that may be a limited portion of the instance of generated aerosol 220 drawn through the sensor apparatus 100 during the ongoing instance of drawn aerosol 230, and the representation of instance $I_{26}$ may include separate portions 543, 544 having separate, first and second highlightings.

As shown in FIG. 4B, based on the control of the amount of remainder generated aerosol 290 included in the instances of drawn aerosol 230 during the time period, the total cumulative amount 521 of remainder generated aerosol 290 during the time period is a threshold cumulative amount 556B that is less than the total threshold amount 431 for the same time period.

Accordingly, as shown in at least FIG. 4B, a sensor apparatus 100 may be configured to adjustably control one or more flow control devices 292, 294, 296, 298 thereof to cause the time-varying cumulative amount of remainder generated aerosol 290 included in instances of drawn aerosol 230 in a given time period to not exceed the time-varying maximum amount of remainder generated aerosol 290 as defined by the threshold aerosol draw pattern 430 such that the flow of the remainder generated aerosol 290 is caused to conform to the threshold aerosol draw pattern 430.

It will be understood that, in some example embodiments, a threshold aerosol draw pattern, such as the threshold aerosol draw pattern 430, may be a stored threshold aerosol draw pattern that may be accessed from a storage device and compared with an aerosol draw pattern, such as the aerosol draw pattern 420 as shown in FIG. 4A and/or the aerosol draw pattern 520 as shown in FIG. 4B. In some example embodiments, the threshold aerosol draw pattern may be a particular threshold aerosol draw pattern that may be selected and/or predetermined and compared with an aerosol draw pattern, such as the aerosol draw pattern 420 as shown in FIG. 4A and/or the aerosol draw pattern 520 as shown in FIG. 4B.

It will be understood that, in some example embodiments, a threshold cumulative amount of the portion of the generated aerosol drawn through the conduit over the period of time, such as the threshold cumulative remainder generated aerosol 290, may be a stored value and/or algorithmic representation that may be accessed from a storage device and compared with an aerosol draw pattern, such as the aerosol draw pattern 420 as shown in FIG. 4A and/or the aerosol draw pattern 520 as shown in FIG. 4B. In some example embodiments, the a threshold cumulative amount of the portion of the generated aerosol drawn through the conduit over the period of time may be a particular value and/or algorithmic representation that may be selected and/or predetermined and compared with an aerosol draw pattern, such as the aerosol draw pattern 420 as shown in FIG. 4A and/or the aerosol draw pattern 520 as shown in FIG. 4B.

It will be understood that in some example embodiments controlling a flow of a given aerosol may include controlling a flow rate of the given aerosol through one or more portions of the conduit 129 at one or more times during a time period, controlling an amount of the given aerosol that is drawn through one or more portions of the conduit 129 at one or more times during a time period, a sub-combination thereof, or a combination thereof.

Figure 5:
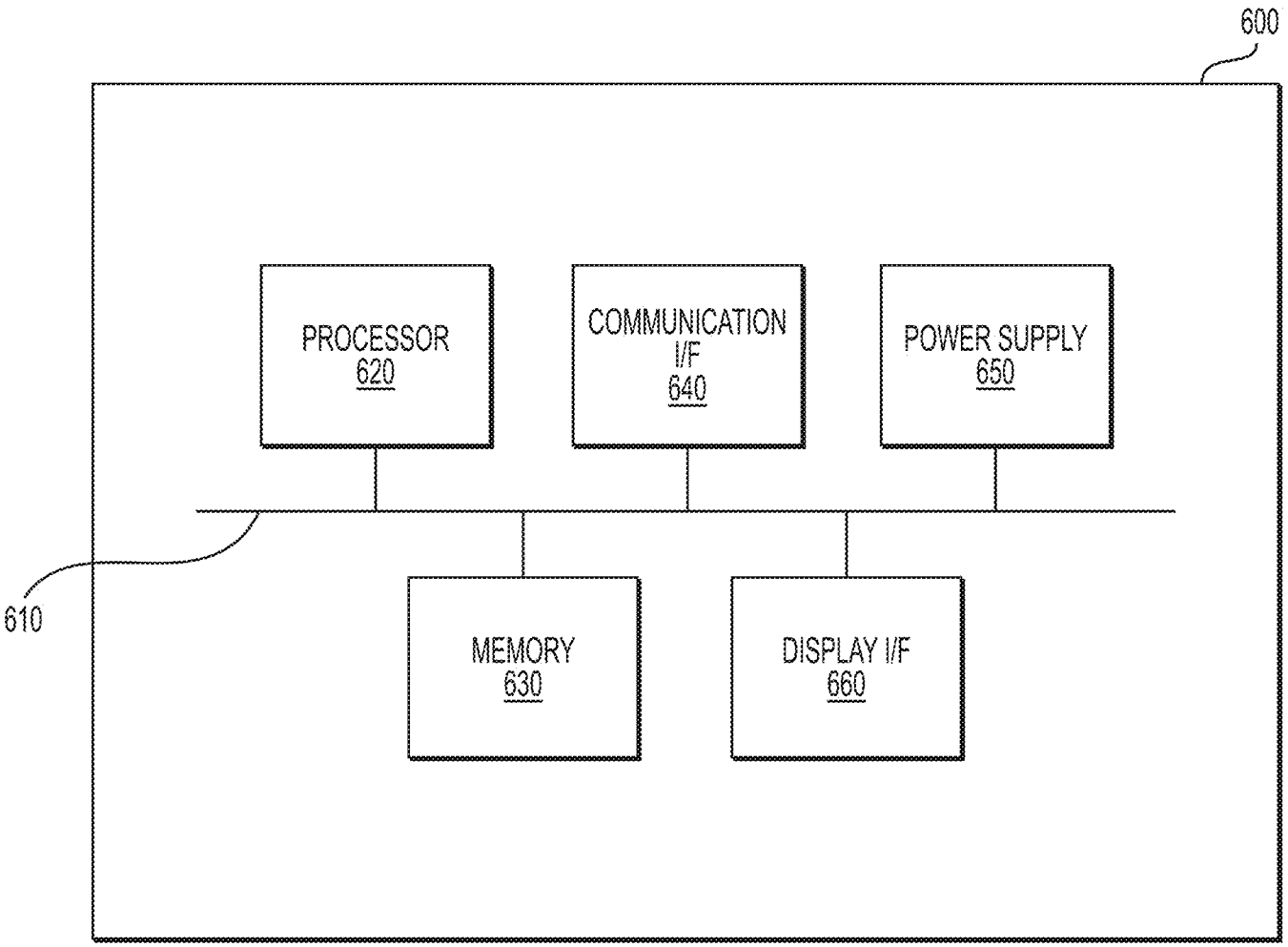
FIG. 5 is a block diagram of an electronic device according to some example embodiments.

FIG. 5 is a block diagram of an electronic device 600 according to some example embodiments. The electronic device 600 shown in FIG. 5 may include and/or be included in any of the electronic devices described herein, including the sensor apparatus 100, the computing device 302, some combination thereof, or the like. In some example embodiments, some or all of the electronic device 600 may be configured to implement some or all of one or more of the electronic devices described herein.

Referring to FIG. 5, the electronic device 600 includes a processor 620, a memory 630, a communication interface 640, and a power supply 650. As further shown, in some example embodiments the electronic device 600 may further include a display interface.

In some example embodiments, the electronic device 600 may include a computing device. A computing device may include a computer, a personal computer (PC), a smartphone, a tablet computer, a laptop computer, a netbook, some combination thereof, or the like. The processor 620, the memory 630, the communication interface 640, the power supply 650, and the display interface 660 may communicate with one another through a bus 610.

The processor 620 may execute a program of instructions to control the at least a portion of the electronic device 600. The program of instructions to be executed by the processor 620 may be stored in the memory 630.

The processor 620 may be a central processing unit (CPU), a controller, or an application-specific integrated circuit (ASIC), that when executing a program of instructions stored in the memory 630, configures the processor 620 as a special purpose computer to perform the operations of one or more of the modules and/or devices described herein.

The processor 620 may execute a program of instructions to implement one or more portions of an electronic device 600. For example, the processor 620 may execute a program of instructions to implement one or more "modules" of the electronic device 600, including one or more of the "modules" described herein. In another example, the processor 620 may execute a program of instructions to cause the execution of one or more methods, functions, processes, etc. as described herein.

The memory 630 may store information. The memory 630 may be a nonvolatile memory, such as a flash memory, a phase-change random access memory (PRAM), a magneto-resistive RAM (MRAM), a resistive RAM (ReRAM), or a ferro-electric RAM (FRAM), or a volatile memory, such as a static RAM (SRAM), a dynamic RAM (DRAM), or a synchronous DRAM (SDRAM). The memory 630 may be a non-transitory computer readable storage medium.

The communication interface 640 may communicate data from an external device using various Internet protocols. The external device may include, for example, a computing device, a sensor apparatus, an AR/VR display, a server, a network communication device, some combination thereof, or the like. In some example embodiments, the communication interface 640 may include a USB and/or HDMI interface. In some example embodiments, the communication interface 640 may include a wireless network communication interface.

The power supply 650 may be configured to supply power to one or more of the elements of the electronic device 600 via the bus 610. The power supply 650 may include one or more electrical batteries. Such one or more electrical batteries may be rechargeable.

The display interface 660, where included in an electronic device 600, may include one or more graphical displays configured to provide a visual display of information. A display interface 660 may include a light-emitting diode (LED) and/or liquid crystal display (LCD) display screen. The display screen may include an interactive touchscreen display.

The units and/or modules described herein may be implemented using hardware components, software components, or a combination thereof. For example, the hardware components may include microcontrollers, memory modules, sensors, amplifiers, band-pass filters, analog to digital converters, and processing devices, or the like. A processing device may be implemented using one or more hardware device(s) configured to carry out and/or execute program code by performing arithmetical, logical, and input/output operations. The processing device(s) may include a processor, a controller and an arithmetic logic unit, a digital signal processor, a microcomputer, a field programmable array, a programmable logic unit, a microprocessor or any other device capable of responding to and executing instructions in a defined manner. The processing device(s) may run an operating system (OS) and one or more software applications that run on the OS. The processing device also may access, store, manipulate, process, and create data in response to execution of the software. For purpose of simplicity, the description of a processing device is used as singular; however, one skilled in the art will appreciated that a processing device may include multiple processing elements and multiple types of processing elements. For example, a processing device may include multiple processors or a processor and a controller. In addition, different processing configurations are possible, such as parallel processors, multi-core processors, distributed processing, or the like.

Example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

What is claimed:

1. A sensor apparatus, comprising:

a conduit structure including an inlet opening, an outlet opening, and an inner surface defining a conduit extending between the inlet opening and the outlet opening through an interior of the conduit structure;

an inlet structure coupled to an inlet opening-proximate end of the conduit structure, the inlet structure further configured to couple with an outlet end of an external tobacco element to hold the outlet end of the external tobacco element in fluid communication with the inlet opening of the conduit structure, such that the conduit structure is configured to receive a generated aerosol from the external tobacco element at the inlet opening, and draw an instance of aerosol through at least a portion of the conduit to the outlet opening, the instance of aerosol including at least a portion of the generated aerosol;

an orifice structure partitioning the conduit into separate conduit portions, the orifice structure including an orifice having a reduced diameter relative to a diameter of the conduit, such that the conduit structure is configured to direct the instance of aerosol to pass through the orifice towards the outlet opening;

flow control devices including an adjustable valve device, an adjustable vent device, and an adjustable intake device, configured to control a flow rate of the instance of aerosol through at least the portion of the conduit to the outlet opening; and a plurality of sensor devices in hydrodynamic contact with separate conduit portions of the conduit on opposite sides of the orifice structure, each sensor device configured to generate sensor data indicating a pressure of the instance of aerosol drawn through a separate portion of the conduit, wherein the sensor apparatus is configured to generate information indicating a flow rate of the instance of aerosol drawn through at least the portion of the conduit to the outlet opening based on a difference between pressures indicated by respective instances of sensor data generated by the plurality of sensor devices in hydrodynamic contact with the separate conduit portions of the conduit on opposite sides of the orifice structure, wherein the sensor apparatus is configured to control the flow control devices, wherein the adjustable vent device is connected to the conduit between the inlet opening and the outlet opening, the adjustable valve device is connected to the conduit between the adjustable vent device and the outlet opening, and the adjustable intake device is connected to the conduit between the adjustable valve device and the outlet opening, such that the adjustable valve device is between the adjustable vent device and the adjustable intake device.

2. The sensor apparatus of claim 1, further comprising:

a communication interface configured to establish a communication link with an external computing device, the communication interface further configured to communicate a sensor data stream, between the sensor apparatus and the external computing device via the communication link, the sensor data stream providing a real-time indication of the flow rate of the instance of aerosol through at least the portion of the conduit to the outlet opening.

3. The sensor apparatus of claim 2, wherein the communication interface is a wireless communication interface and the communication link is a wireless network communication link.

4. The sensor apparatus of claim 2, wherein the sensor apparatus is configured to control the flow control devices based on a feedback control signal received from the external computing device at the communication interface.

5. The sensor apparatus of claim 1, wherein the sensor apparatus is configured to control the flow control devices to cause an aerosol draw pattern of the instance of aerosol drawn through at least the portion of the conduit to the outlet opening of the sensor apparatus over a period of time to conform to a threshold aerosol draw pattern, the aerosol draw pattern being associated with the sensor data.

6. A system, comprising:

the sensor apparatus of claim 1; and a computing device communicatively linked to a communication interface of the sensor apparatus via a communication link, wherein the sensor apparatus is configured to communicate, between the sensor apparatus and the computing device via the communication link, a data stream providing a real-time indication of the flow rate of the instance of aerosol drawn through at least the portion of the conduit to the outlet opening, the data stream including information associated with the sensor data, wherein at least one device of the sensor apparatus or the computing device is configured to process the information associated with the sensor data to generate topography information associated with at least one of the sensor apparatus and the external tobacco element, wherein the topography information includes an aerosol draw pattern of the instance of aerosol drawn through the conduit over a period of time, the aerosol draw pattern associated with the sensor data, the aerosol draw pattern representing a time variation of a cumulative amount of aerosol in one or more instances of aerosol drawn through the conduit during a given time period, from a null value at a start of the given time period to a total cumulative amount at an end of the given time period, wherein the computing device is configured to display the topography information to provide graphical representations of the time variation of the cumulative amount of aerosol in the one or more instances of aerosol drawn through the conduit during the given time period, a time variation of a threshold cumulative amount of aerosol drawn through the conduit during the given time period, the threshold cumulative amount of aerosol varying with time over the given time period, and a difference between the cumulative amount of aerosol and the threshold cumulative amount of aerosol at multiple given times throughout the given time period.

7. The system of claim 6, wherein the communication interface is a wireless communication interface and the communication link is a wireless network communication link.

8. The system of claim 6, wherein the at least one device is the computing device, the computing device is further configured to communicate a feedback control signal to the sensor apparatus according to a determination of whether the aerosol draw pattern conforms to the threshold aerosol draw pattern, and the sensor apparatus is configured to control a flow rate of the portion of the generated aerosol through the conduit based on the feedback control signal.

9. A method, comprising:

generating, at a sensor apparatus, sensor data indicating a flow rate of an instance of aerosol that is drawn through a conduit of the sensor apparatus from an external tobacco element coupled to the sensor apparatus and to an outlet opening of the conduit;

communicating a data stream between the sensor apparatus and an external computing device via a communication link, the data stream providing a real-time indication or near real-time indication of the flow rate of the instance of aerosol through the conduit, the data stream including information associated with the sensor data;

processing the information associated with the sensor data, at at least one device of the sensor apparatus and the external computing device, to generate topography information associated with the sensor apparatus; and displaying the topography information, wherein the topography information includes an aerosol draw pattern of the instance of aerosol drawn through the conduit over a period of time, the aerosol draw pattern associated with the sensor data, the aerosol draw pattern representing a time variation of a cumulative amount of aerosol in one or more instances of aerosol drawn through the conduit during a given time period, from a null value at a start of the given time period to a total cumulative amount at an end of the given time period, wherein the displaying the topography information provides graphical representations of the time variation of the cumulative amount of aerosol in the one or more instances of aerosol drawn through the conduit during the given time period, a time variation of a threshold cumulative amount of aerosol drawn through the conduit during the given time period, the threshold cumulative amount of aerosol varying with time over the given time period, and a difference between the cumulative amount of aerosol and the threshold cumulative amount of aerosol at multiple given times throughout the given time period.

10. The method of claim 9, wherein the communication link is a wireless network communication link.

* * * * *